US006094184A

United States Patent [19]

Okamoto

[11] Patent Number: 6,094,184

[45] Date of Patent: Jul. 25, 2000

[54] DRIVING METHOD AND DRIVING CIRCUIT FOR FERROELECTRIC LIQUID CRYSTAL DISPLAY ELEMENT

[75] Inventor: Shigetsugu Okamoto, Toride, Japan

[73] Assignees: Sharp Kabushiki Kaisha, Osaka, Japan; The Secretary of State for Defence in Her Britannic Majesty's Government of the United Kingdom of Great Britain and Northern Ireland, Hants, United Kingdom

[21] Appl. No.: 09/047,767

[22] Filed: Mar. 25, 1998

[30] Foreign Application Priority Data

Apr. 2, 1997 [JP] Japan ..... 9-083770

[51] Int. Cl.[7] ..... G09G 3/36

[52] U.S. Cl. ..... 345/89; 345/97

[58] Field of Search ..... 345/89, 97

[56] References Cited

U.S. PATENT DOCUMENTS

| | | | |
|---|---|---|---|
| 5,126,864 | 6/1992 | Akiyama et al. | 359/53 |
| 5,812,230 | 9/1998 | Sakaigawa et al. | 349/166 |

FOREIGN PATENT DOCUMENTS

| | | |
|---|---|---|
| 0272079 | 6/1988 | European Pat. Off. . |
| 0603848 | 6/1994 | European Pat. Off. . |
| 62-17734 | 1/1987 | Japan . |
| 63-201629 | 8/1988 | Japan . |
| 5-088646 | 4/1993 | Japan . |
| 5-127625 | 5/1993 | Japan . |
| 6-018854 | 1/1994 | Japan . |
| 6-235904 | 8/1994 | Japan . |
| 7-005432 | 1/1995 | Japan . |
| 7-152017 | 6/1995 | Japan . |
| 2293905 | 4/1996 | United Kingdom . |

OTHER PUBLICATIONS

Search Report for Application No. GB 9806885.1; Mailed Jun. 25, 1998.

U.S. Patent Application Serial No. 09/066,105; Filed Apr. 24, 1998.

*Primary Examiner*—Jeffery Brier

*Attorney, Agent, or Firm*—Renner, Otto, Boisselle & Sklar LLP

[57] ABSTRACT

A ferroelectric liquid crystal display element is structured so that ferroelectric liquid crystal is provided between a plurality of signal line electrodes and a plurality of scanning line electrodes running perpendicular to one another, and includes a signal line electrode driving circuit made up of a gray-scale signal amplifying circuit and a gray-scale signal producing circuit, and a scanning line electrode driving circuit made up of a scanning signal amplifying circuit and a scanning signal producing circuit. The signal line electrode driving circuit applies to the signal line electrodes gray-scale signals including pulses which are phase modulated in accordance with a gray-scale level, and the scanning line electrode driving circuit selectively applies to the scanning line electrodes scanning signals including, in each scanning period, an erasure voltage, a selection voltage, and a non-selection voltage. Driving characteristics obtained by these means are more stable than those obtained using amplitude-modulated or frequency-modulated gray-scale signals. As a result, intermediate shades can be stably displayed in a display element using ferroelectric liquid crystal.

13 Claims, 17 Drawing Sheets

DRIVING METHOD AND DRIVING CIRCUIT FOR FERROELECTRIC LIQUID CRYSTAL DISPLAY ELEMENT

FIELD OF THE INVENTION

The present invention concerns a driving method and driving circuit for gray-scale display in a passive-matrix liquid crystal display element which uses a ferroelectric liquid crystal.

BACKGROUND OF THE INVENTION

Ferroelectric liquid crystal (hereinafter referred to as "FLC" as necessary) has a higher order of alignment than the nematic phase, known as "smectic phase," and its state is semi-solid. For this reason, if the alignment of FLC is altered by external pressure, it will not easily return to its original state of alignment. When FLC is provided in a layer with a thickness of a few micrometers or less, the alignment of the molecules is stabilized by the action force of the substrate interface. In such a state, the alignment state of the molecules shows bistability. In a so-called surface-stabilized liquid crystal display element, display is performed using the bistability of the liquid crystal molecules.

When an electric field is applied to FLC, it becomes spontaneously polarized in the smectic phase, and shows biaxial anisotropy of the dielectric constant, and changes the alignment of its molecules due to these two action forces. Consequently, by reversing the spontaneous polarization of the FLC in response to the polarity of an electric field, the FLC can be switched between two stable states at a speed of several microseconds. Further, since switching is performed in the plane of the cell, FLC has characteristics which enable display with a wide viewing angle.

Since, as discussed above, FLC can only be switched between bistable alignment states, only two-value display is possible. For this reason, FLC in a crossed Nicols cell shows, in display, an optical response of light state and dark state. Consequently, in an FLC cell, it is very difficult to perform display at intermediate states other than light state and dark state. Conventional FLC cells which resolved this inconvenience include, for example, the following four methods of performing gray-scale display by changing the average light transmittance.

(1) Frame Division Driving Method

In this driving method, each frame is divided into a plurality of fields of suitable duration, and two-value display is performed in each field (Japanese Unexamined Patent Publication Nos. 6-18854/1994 (Tokukaihei 6-18854) and 5-88646/1993 (Tokukaihei 5-88646)). For example, when each frame is divided in a ratio of 1:2:4, display with eight gradations is possible.

(2) Pixel Division Driving Method

In this method, the pixel electrode of each pixel is divided into a plurality of electrodes of suitable area ratio, and each electrode is driven separately so as to perform two-value display in a sub-pixel corresponding to each electrode (Japanese Unexamined Patent Publication No. 7-5432/1995 (Tokukaihei 7-5432)). For example, when each pixel electrode is divided in a ratio of 1:2:4, display with eight gradations is possible.

(3) Combination of Frame Division and Pixel Division Driving Methods

In this driving method, by combining the two foregoing methods, display with more gradations can be realized (Japanese Unexamined Patent Publication No. 7-152017/1995 (Tokukaihei 7-152017)). For example, when each frame is divided in a ratio of 1:8:64, each pixel electrode is divided in a ratio of 1:2:4, and each sub-pixel is driven so as to perform two-value display, display with 512 gradations is possible.

(4) Threshold Voltage Distribution Driving Method

In this driving method, the proportion of light-state and dark-state domains in each pixel is changed by controlling a group of amplitude-modulated or pulse-width-modulated pulses (Japanese Unexamined Patent Publication Nos. 7-152017/1995 (Tokukaihei 7-152017) and 6-235904/1994 (Tokukaihei 7-235907)). In principle, this method performs two-value driving, but analog-like gray-scale display is realized by providing in each pixel a plurality of domains with liquid crystal with progressively different voltage thresholds.

At present, in gray-scale driving with FLC, display with many gradations is realized by using one of the foregoing driving methods, or by combining several of them together.

The following will explain in outline a representative example of driving using the foregoing driving methods.

In a passive matrix liquid crystal display element, for example that shown in FIG. 15, a plurality of scanning line electrodes 101 . . . and a plurality of signal line electrodes 102 . . . are provided opposite one another and running perpendicularly. A single pixel is formed by each intersection of a scanning line electrode 101 with a signal line electrode 102. In this liquid crystal display element, the state of alignment of each pixel is controlled in accordance with the timing with which strobe pulses (selection pulses) and blanking pulses (erasure pulses) are applied to each scanning line electrode 101, and with a gray-scale signal (or two-value signal) applied to each signal line electrode 102.

To each scanning line electrode 101 are applied, in succession, scanning signals SCAN 1, . . . , SCAN n+1, for example, with the timing shown in FIG. 6. In this example, the aim is to reset the alignment state of the pixel to one of the stable states by means of a blanking pulse $P_b$ with voltage $V_b$, and then to control the alignment during a selection period by means of a strobe pulse $P_s$ with voltage $V_s$. The area of each of the pulses $P_b$ and $P_s$ is equivalent, and the two are balanced, from the point of view of direct current (DC balanced), within each scanning period. Further, each blanking pulse $P_b$ forms a pair with a strobe pulse $P_s$, making up a minimum frame.

The blanking pulse $P_b$ and the strobe pulse $P_s$ may have shapes other than those shown in FIG. 6. For example, provided that erasure and selection functions can be attained, and that the two pulses are balanced from the point of view of direct current, it does not matter if the respective polarities of the blanking pulse $P_b$ and the strobe pulse $P_s$ are reversed in each frame. Again, each of the pulses $P_b$ and $P_s$ may have both positive and negative polarity without any adverse effects.

The scanning signal in FIG. 6 is composed of two sub-frames (scanning periods) per frame: a first sub-frame and a second sub-frame. In this example, the duration from a blanking pulse $P_b$ to the subsequent strobe pulse $P_s$ is set to the same proportion in both the first and second sub-frames. Further, in both the first and second sub-frames, durations $T_1$ and $T_2$ from the strobe pulse $P_s$ to the subsequent blanking pulse $P_b$ are set to a ratio of 1:5. Using a scanning signal of this kind, if each sub-frame is capable of, for example, gray-scale display with five gradations, each frame can perform display with 25 gradations.

Further, if each signal line electrode 102 is composed, as shown in FIG. 16, of two electrodes 102*a* and 102*b*, provided with a width ratio of 1:2, even more gradations can be realized. For example, if the sub-pixel corresponding to each electrode 102*a* and 102*b* is capable of display with five gradations, the pixel composed of these sub-pixels will be capable of display with 13 gradations. If the ratio between $T_1$ and $T_2$ shown in FIG. 6 is set to 1:13, display can be performed with 169 gradations per frame.

A scanning voltage $V_Y$ and a signal voltage $V_X$, having, for example, the wave-forms shown in FIG. 17, are applied to each scanning line electrode 101 and each signal line electrode 102, respectively. Accordingly, a pixel voltage $V_{Y-X}$, which is the difference between the scanning voltage $V_Y$ and the signal voltage (gray-scale voltage) $V_X$, is applied to each pixel.

During a blanking period (erasure period), a group of pulses are formed which have voltage levels of $V_b \pm V_d$. Consequently, the liquid crystal is reset to one of its stable states, which it maintains during periods when the blanking pulse $P_b$ is not applied.

During a selection period, a group of pulses are formed which have voltage levels of $V_s \pm V_d$. By this means, a voltage with a wave-form having driving characteristics capable of obtaining a predetermined gradation is applied to the FLC in the pixel in question. During non-selection periods, gray-scale signals are applied which select the display of pixels at the intersections of the same signal line electrode 102 with other scanning lines 101, and the group of pulses in these gray-scale signals can, in the pixel in question, maintain the stable state selected during the selection period.

As shown in FIG. 19, each of gray-scale signals DATA0 through DATA4, produced by amplitude modulation, has a different wave-form. When these gray-scale signals DATA0 through DATA4 are used as the signal line voltage $V_X$, the pixel voltage $V_{Y-X}$ is as shown in FIG. 18.

In the examples in FIGS. 17 and 18, gray-scale signals are used whose aim is analog gray-scale driving. However, gray-scale display equivalent to that of conventional digital technology can be performed by only using the two wave-forms of these gray-scale signals which realize light state and dark state.

With actual driving methods, in consideration of the liquid crystal's speed of response to driving, and of the duty ratio, the upper limit for frame division is two to three divisions. Again, in consideration of increase of the number of drivers, a suitable number for pixel division is two sub-pixels. Division into three sub-pixels is possible, but this leads to many problems with display characteristics. Because of these limitations of two-value driving, a driving method for FLC gray-scale driving is called for in which the FLC itself shows intermediate shades.

As discussed above, in driving an FLC cell, the liquid crystal can be switched between two bistable states. However, the voltage threshold for shift between the bistable states is not necessarily steep; between the light state and dark state, an intermediate state exists across a voltage range of several volts. Accordingly, with conventional two-value driving, bistable switching was performed using a cell which provided a driving voltage and a mono-domain capable of avoiding this intermediate state.

Since it was comparatively difficult to control this intermediate state, and to obtain stable domain distribution, using conventional driving methods whose object was two-value driving, several methods of obtaining stable domains have been proposed.

For example, Japanese Unexamined Patent Publication No. 6-235904/1994 (Tokukaihei 6-235904) discloses a method of obtaining intermediate shades by distributing domains with different FLC switching thresholds in each pixel using pixel electrodes having a regular slope. Again, Japanese Unexamined Patent Publication No. 7-152017/1995 (Tokukaihei 7-152017) discloses a method of obtaining intermediate shades by distributing domains with different alignment states in each pixel by adding particles to the liquid crystal. Again, in the disclosure of Japanese Unexamined Patent Publication No. 63-201629/1988 (Tokukaisho 63-201629), rubbing processing is performed in two directions on an FLC cell, and a high-frequency pulse is applied to the FLC cell to cause disclination and dislocation, and these result in domain walls, which are controlled to provide multi-domain pixels. Further, Japanese Unexamined Patent Publication No. 9-236830/1997 (Tokukaihei 9-236830; corresponding to U.S. patent application Ser. No. 08/728,200) discusses a method of obtaining intermediate shades by dispersing polymer resin in the FLC, thus forming tiny domains, and changing the distribution of these tiny domains in accordance with a pulse width.

In each of the foregoing methods, a stable intermediate state can be easily obtained by using an amplitude-modulated or pulse-width-modulated driving voltage.

In multiplex driving, a driving signal applied to a given pixel does not always have the same wave-form; patterns to be applied are formed by combining powers of numbers of driving signals having wave-forms which realize intermediate shades. In display, stable intermediate shades must be obtained with each of these combinations. In other words, driving signal wave-forms must be designed giving consideration to the influence of driving signal wave-forms applied during non-selection periods.

Driving signal wave-forms using amplitude modulation or pulse-width modulation have the following problems.

As discussed above, with FLC, spontaneous polarization of the molecules and anisotropy of the dielectric constant act with the applied electric field to cause bistable switching. However, at the time of application of an electric field during a selection period or blanking period, one stable state shifts to the other stable state due chiefly to the action of spontaneous polarization. Thereafter, during non-selection periods, alignment is maintained chiefly by the action of anisotropy of the dielectric constant.

FLC molecules have properties whereby, when the anisotropy of the dielectric constant is positive, they try to shift from their alignment position in the stable state to an alignment even more parallel with the applied electric field, and when the anisotropy of the dielectric constant is negative, they try to shift to an alignment more perpendicular to the applied electric field. This is the reason why liquid crystal switched to a stable state has different apparent memory angles when an electric field is applied thereto and when an electric field is not applied thereto.

During non-selection periods, a gray-scale signal of low voltage, just enough to keep the FLC from switching bistably, is always applied to the FLC. In an example disclosed in Japanese Unexamined Patent Publication No. 5-127625/1993 (Tokukaihei 5-127625), in cases where the value of the gray-scale signal's amplitude voltage differs according to the gray-scale level, in certain display patterns, a low voltage or a high voltage is sometimes continuously applied to a given pixel.

In the foregoing example, as shown in FIG. 20, a voltage of $+V_B$, $-V_B$, or 0 is applied to the signal line electrode according to whether the gradation to be displayed is the light, intermediate, or dark state. In this case, since the number of voltages to be applied to a pixel is increased, the action of the anisotropy of the dielectric constant causes the molecules to change their average position, which is the position necessary to maintain a bistable state, and this changes their state of alignment. As a result, the apparent memory angle changes, and this causes change of the quantity of light transmitted. Consequently, even if a certain gradation is selected during a selection period, it becomes impossible to maintain this predetermined gradation in the face of the many combinations of wave-forms of gray-scale signals applied during non-selection periods.

Again, since the FLC molecules always respond to an applied electric field, voltage applied in a period immediately preceding a selection period, for example, will influence switching by voltage application during the selection period. In other words, depending on the way driving voltages are chosen for the signal line electrodes and the scanning line electrodes, switching may become unstable.

With an amplitude-modulated driving voltage, when, as above, a voltage of a certain value is continuously applied, there is a wave-form effect, in which the driving wave-form in a certain period is influenced by the driving wave-form of the immediately preceding period. On the other hand, with a pulse-width-modulated driving signal wave-form like that shown in FIG. 15 (as disclosed in the above-mentioned Japanese Unexamined Patent Publication No. 6-235904/1994), in addition to the influence of this wave-form effect, there are also cases in which combination of wave-forms produces frequency discrepancies in the actual driving signal.

The temperature increase of an FLC cell during driving is proportional to the square of the voltage of the driving signal, and roughly proportional to the frequency of that driving signal. For this reason, with screen display contents which produce the wave-form combination discussed above, the temperature distribution in the screen portion of the FLC cell changes according to the display contents. Since the memory angle and driving characteristics of FLC change with temperature change, in order to stabilize display, it is necessary to hold temperature change in the FLC cell to a minimum.

SUMMARY OF THE INVENTION

The object of the present invention is to provide a driving method and a driving circuit for an FLC display element which are capable of stable display of intermediate shades.

In order to attain the foregoing object, a driving method according to the present invention is a driving method for changing the display state of each pixel of a liquid crystal display element made up of a plurality of scanning line electrodes running perpendicular to a plurality of signal line electrodes, with ferroelectric liquid crystal provided between the scanning line electrodes and the signal line electrodes, and a pixel provided near each intersection of a scanning line electrode with a signal line electrode;

the driving method including the steps of:

(i) a step for applying to a signal line electrode a plurality of gray-scale signals which include pulses which are phase-modulated according to a gray-scale level, and which, from the point of view of direct current, are balanced within each line-address period; at least one of the gray-scale signals being a writing signal which causes the ferroelectric liquid crystal within the pixel to shift to one of two stable states; and at least one of the gray-scale signals being a holding signal which maintains the stable state of the ferroelectric liquid crystal; and (ii) a step for selectively applying to a scanning line electrode a scanning signal which, from the point of view of direct current, is balanced within each scanning period, and which includes an erasure voltage which causes the ferroelectric liquid crystal within the pixel to shift to one of two stable states, a selection voltage which applies the gray-scale signal to the pixel, and a non-selection voltage which maintains the stable state of the ferroelectric liquid crystal; the erasure, selection, and holding voltages being applied, respectively, during an erasure period, a selection period, and a non-selection period of variable length between the selection period and the erasure period, each of which is provided during each scanning period.

In order to attain the foregoing object, a driving circuit according to the present invention is a driving circuit for changing the display state of pixels of a liquid crystal display element made up of a plurality of scanning line electrodes running perpendicular to a plurality of signal line electrodes, with ferroelectric liquid crystal provided between the scanning line electrodes and the signal line electrodes, and a pixel provided near each intersection of a scanning line electrode with a signal line electrode;

the driving circuit including:

(i) a signal line electrode driving circuit for applying to a signal line electrode a plurality of gray-scale signals which include pulses which are phase-modulated according to a gray-scale level, and which, from the point of view of direct current, are balanced within each line-address period; at least one of the gray-scale signals being a writing signal which causes the ferroelectric liquid crystal within the pixel to shift to one of two stable states; and at least one of the gray-scale signals being a holding signal which maintains the stable state of the ferroelectric liquid crystal; and (ii) a scanning line electrode driving circuit for selectively applying to a scanning line electrode a scanning signal which, from the point of view of direct current, is balanced within each scanning period, and which includes an erasure voltage which causes the ferroelectric liquid crystal within the pixel to shift to one of two stable states, a selection voltage which applies the gray-scale signal to the pixel, and a non-selection voltage which maintains the stable state of the ferroelectric liquid crystal; the erasure, selection, and holding voltages being applied, respectively, during an erasure period, a selection period, and a non-selection period of variable length between the selection period and the erasure period, each of which is provided during each scanning period.

In driving an FLC display element using the foregoing driving method and driving circuit, the voltage applied to the pixel is a composite voltage of the voltage of the gray-scale signal in accordance with the gray-scale level, and the erasure voltage, selection voltage, or non-selection voltage, as the case may be.

If the foregoing gray-scale signal is used in this kind of driving, the switching characteristics of the FLC in response to the voltage applied differ according to differences in phase during the selection period. Consequently, intermediate shades can be displayed without using amplitude-modulated or frequency-modulated gray-scale signals. Accordingly, intermediate shades can be displayed stably.

Additional objects, features, and strengths of the present invention will be made clear by the description below. Further, the advantages of the present invention will be evident from the following explanation in reference to the drawings.

DESCRIPTION OF THE EMBODIMENTS

The following will explain an embodiment of the present invention with reference to FIGS. 1 through 14.

Figure 2:
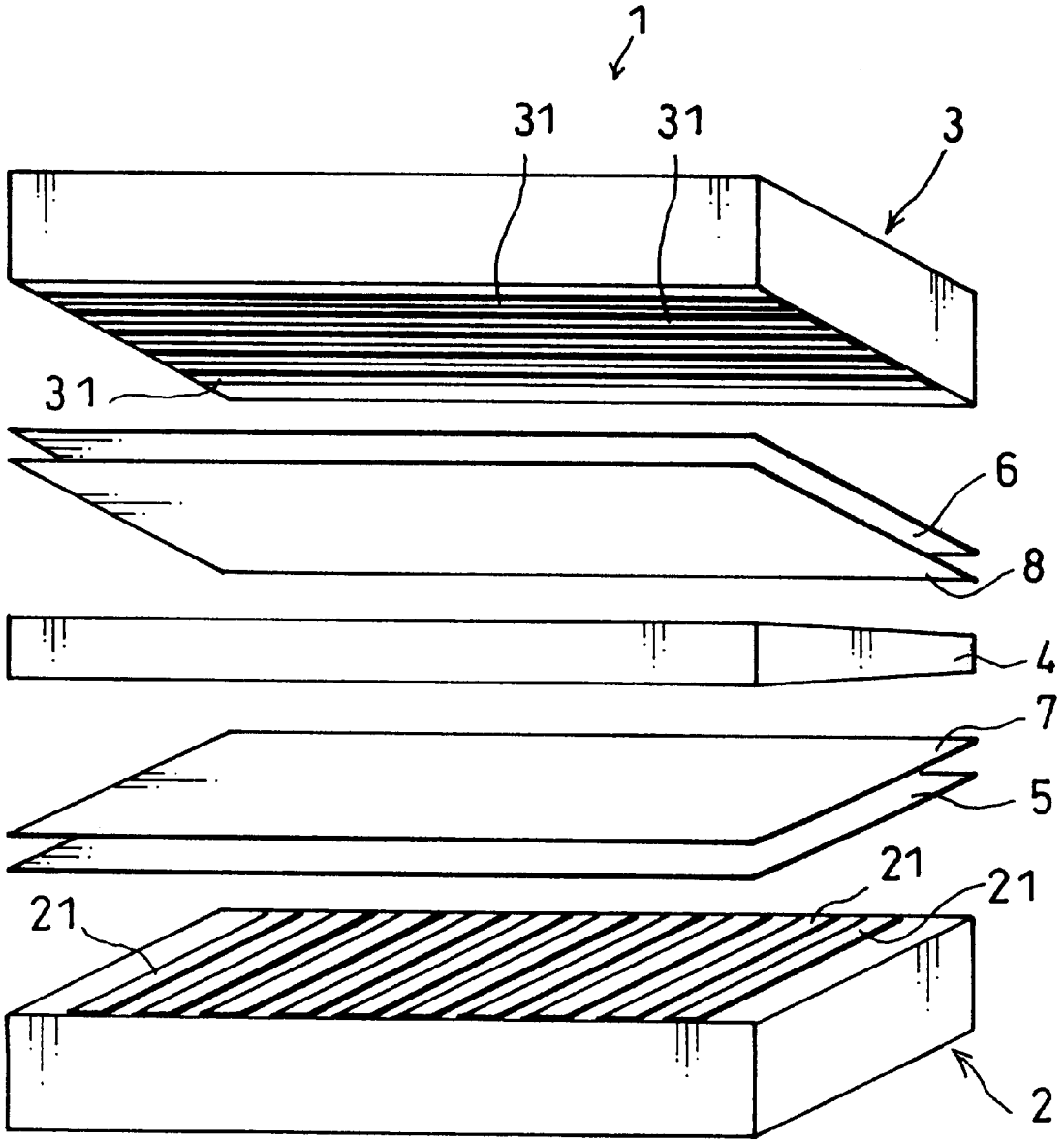
FIG. 2 is a perspective view schematically showing the structure of an FLC cell included in the foregoing FLC module.

As shown in FIG. 2, an FLC cell 1 (ferroelectric liquid crystal display element) according to the present embodiment includes a signal line electrode substrate 2, a scanning line electrode substrate 3, a liquid crystal layer 4, insulating films 5 and 6, and alignment films 7 and 8. On one surface of the signal line electrode substrate 2 are provided a plurality of signal line electrodes 21 . . . , arranged parallel with one another. On the surface of the scanning line electrode substrate 3 facing the signal line electrodes 21 . . . are provided a plurality of scanning line electrodes 31 . . . , arranged parallel with one another, and perpendicular to the signal line electrodes 21 . . . .

The liquid crystal layer 4 is provided between the signal line electrode substrate 2 and the scanning line electrode substrate 3. The insulating film 5 and the alignment film 7 are provided between the signal line electrode substrate 2 and the liquid crystal layer 4, and the insulating film 6 and the alignment film 8 are provided between the scanning line electrode substrate 3 and the liquid crystal layer 4.

Figure 3:
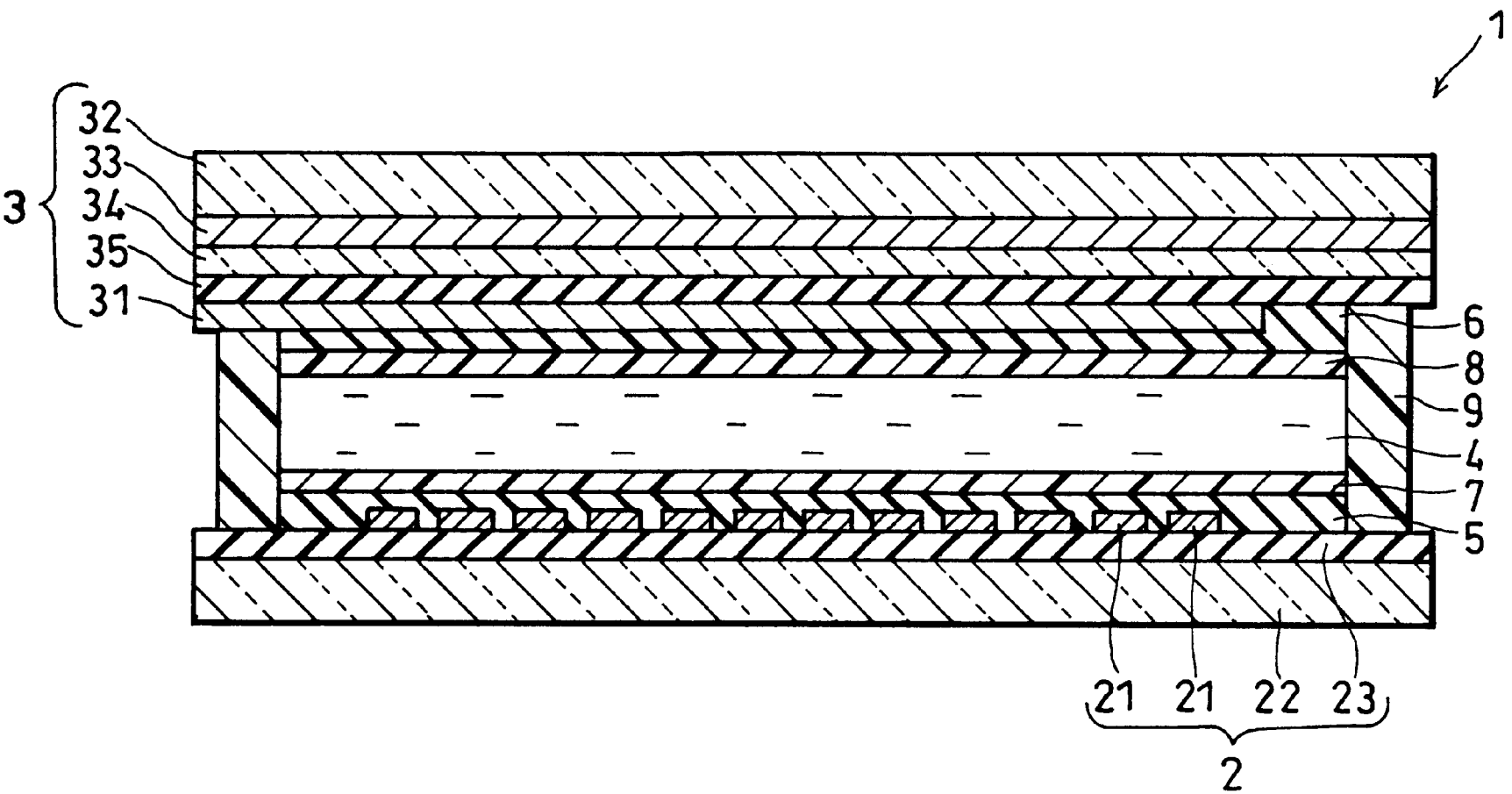
FIG. 3 is a cross-sectional view showing the structure of the foregoing FLC cell in more detail.

In detail, an FLC cell 1 structured as above has the structure shown in FIG. 3.

The signal line electrode substrate 2 includes a glass substrate 22, an SiO layer 23 provided on the glass substrate 22, and, on the SiO layer 23, the transparent signal line electrodes 21 . . . , which are made of ITO (indium tin oxide).

The scanning line electrode substrate 3 includes a glass substrate 32, a color filter 33 provided on the glass substrate 32, and, covering the color filter 33, an overcoat film 34 and an SiO layer 35. On the SiO layer 35 are provided the transparent scanning lines 31 . . . , which are made of ITO. The color filter 33 is divided into portions which transmit red, green, and blue light, respectively. A black matrix (not shown) blocks light from passing between these respective portions. The overcoat film 34 is made of a transparent material such as an acrylic resin.

In the signal line electrode substrate 2 and the scanning line electrode substrate 3, instead of the substrates 22 and 32, substrates made of an insulating and transparent material such as plastic or silicon may be used.

On the insulating films 5 and 6 are provided the alignment films 7 and 8, respectively, on which uniaxial alignment processing such as rubbing processing has been performed. For the alignment films 7 and 8, a film made of an organic polymer such as polyimide, nylon, or polyvinyl alcohol, or one made of an $SiO_2$ oblique evaporation film, may be used.

The signal line electrode substrate 2 and the scanning line electrode substrate 3 are combined opposite one another using a sealant 9. The liquid crystal layer 4 is provided with a predetermined thickness by filling the gap between the two substrates 2 and 3 with an FLC material. Further, if the FLC cell 1 has a large display area, spacers (not shown) are provided between the alignment films 7 and 8 in order to ensure that the cell gap (the thickness of the liquid crystal layer 4) is uniform.

The FLC cell 1 is sandwiched between two polarizing plates (not shown) whose polarizing axes are perpendicular to one another.

In the FLC cell 1, each rectangular area formed by the intersections of the signal line electrodes 21 . . . and the scanning line electrodes 31 . . . corresponds to a pixel area. The display state of a pixel area is changed from light to dark, and vice versa, by switching the alignment of the FLC molecules in the liquid crystal layer 4 by applying voltage through the corresponding signal line electrode 21 and scanning line electrode 31.

Figure 1:
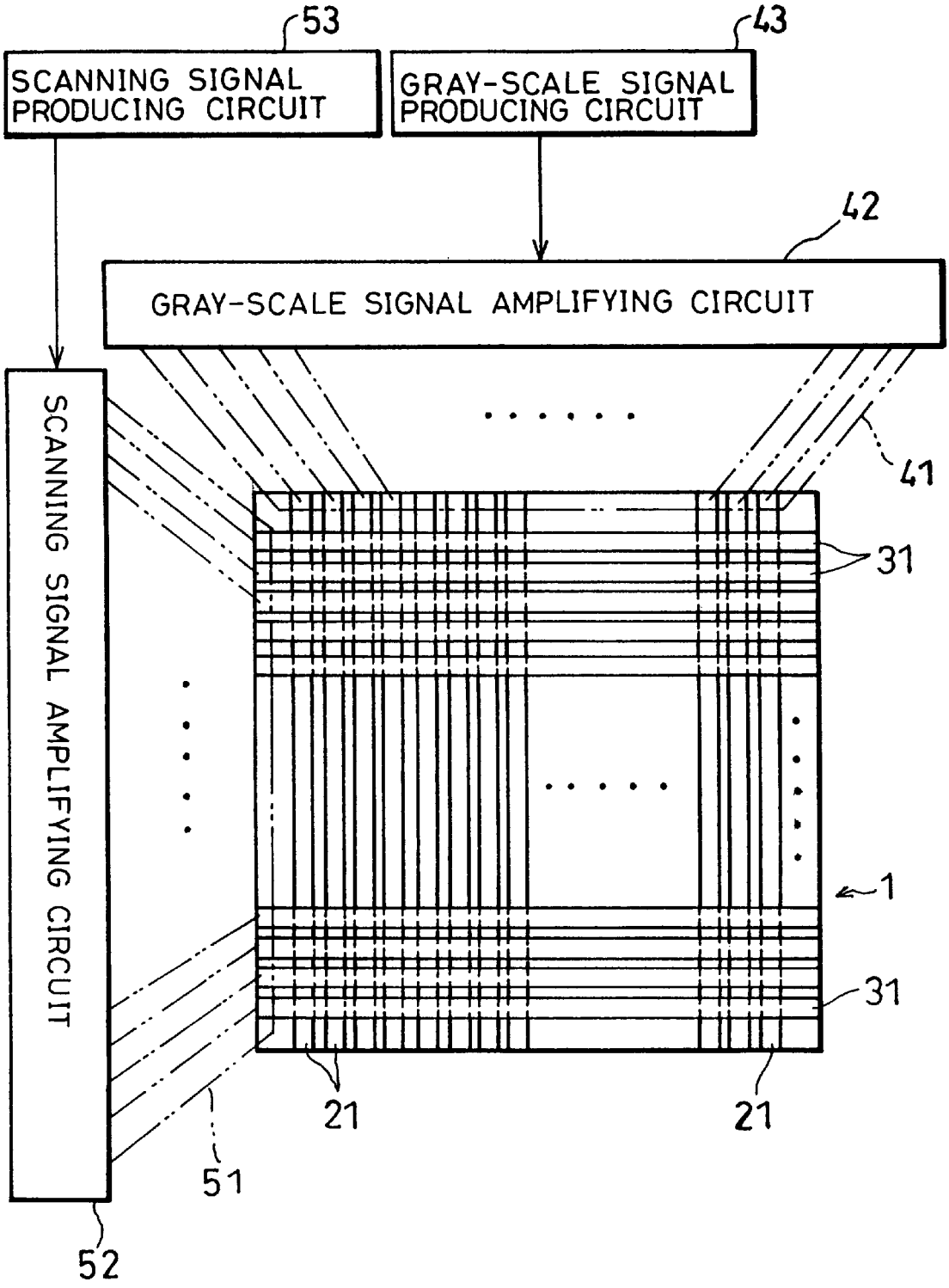
FIG. 1 is a block diagram schematically showing the structure of an FLC module according to an embodiment of the present invention.

FIG. 1 schematically shows the structure of an FLC module. In this FLC module, the signal line electrodes 21 .

. . are connected to a gray-scale signal amplifying circuit 42 via a flexible print substrate 41. Five types of gray-scale signals, to be discussed below, which are produced by a gray-scale signal producing circuit 43, are combined, amplified, and sent to each signal line electrode 21 by the gray-scale signal amplifying circuit 42. The gray-scale signal amplifying circuit 42 and the gray-scale signal producing circuit 43 form parts of the signal line electrode driving circuit of the present FLC module.

Figure 4:
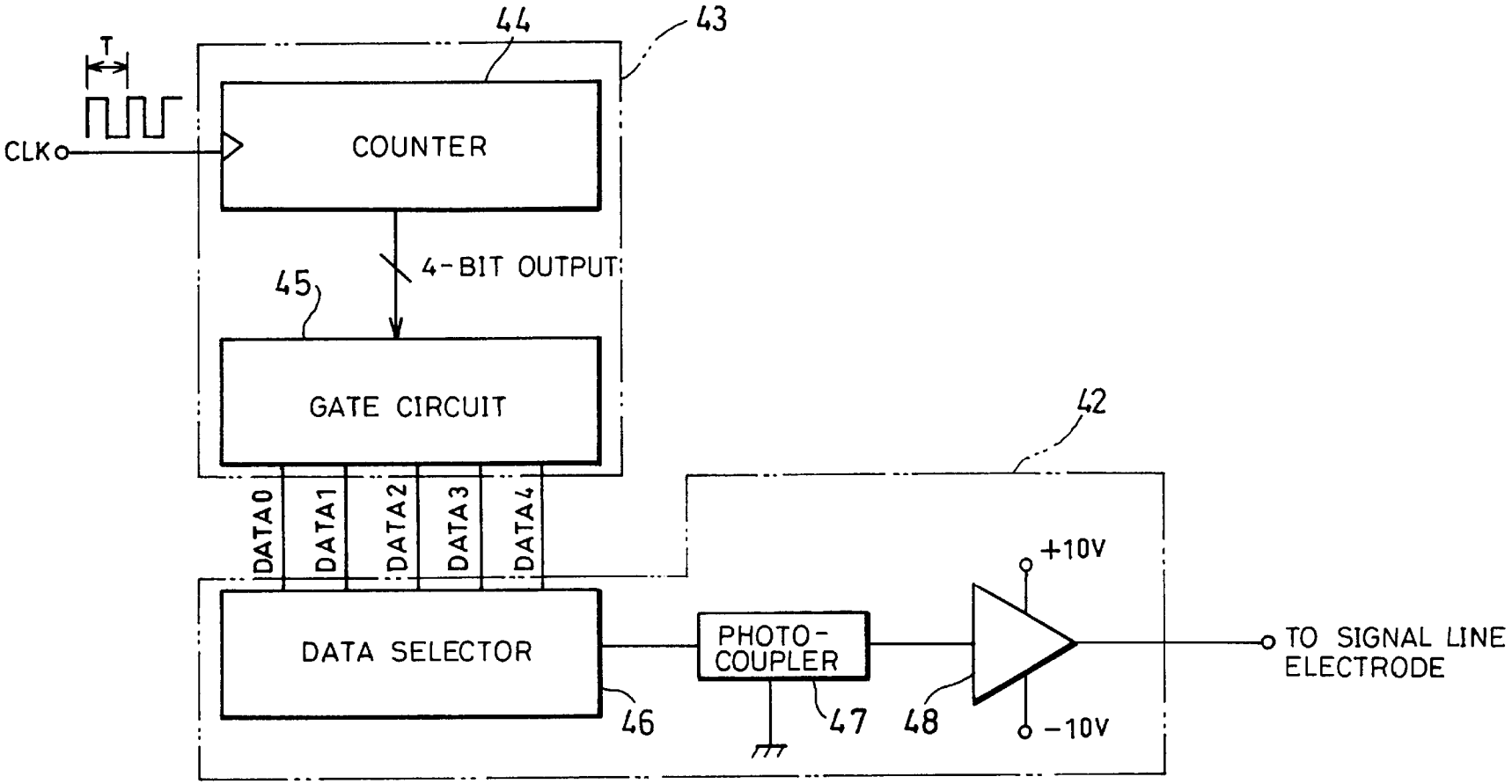
FIG. 4 is a block diagram showing the main parts of a signal line electrode driving circuit included in the foregoing FLC module.
Figure 5A:
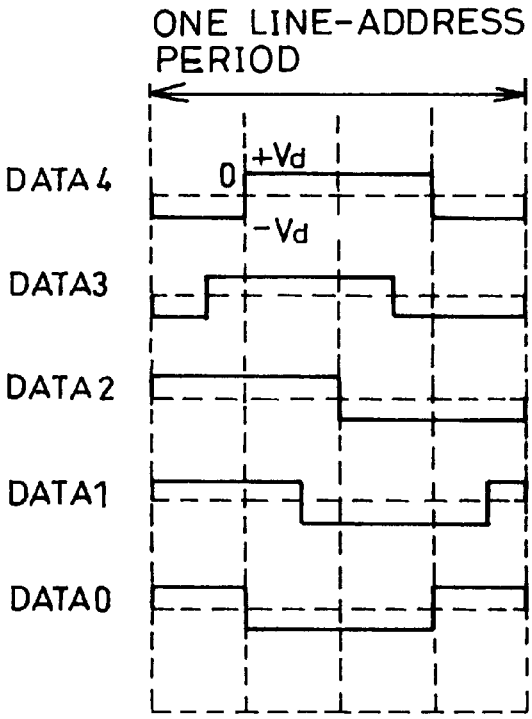
FIGS. 5(*a*) through 5(*d*) are wave-form diagrams showing four types of gray-scale signals applied to the foregoing FLC cell.
Figure 5B:
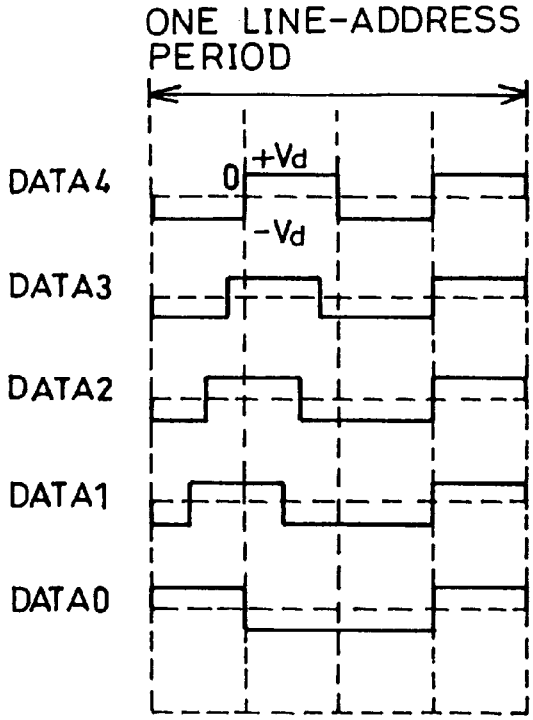
Figure 5C:
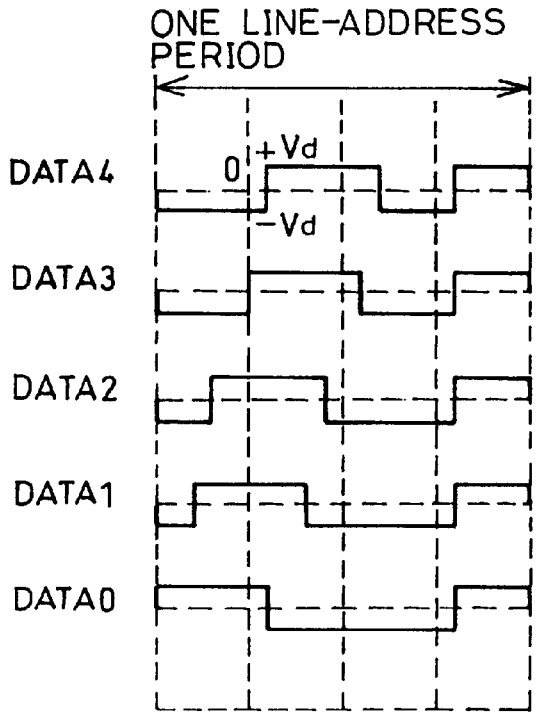
Figure 5D:
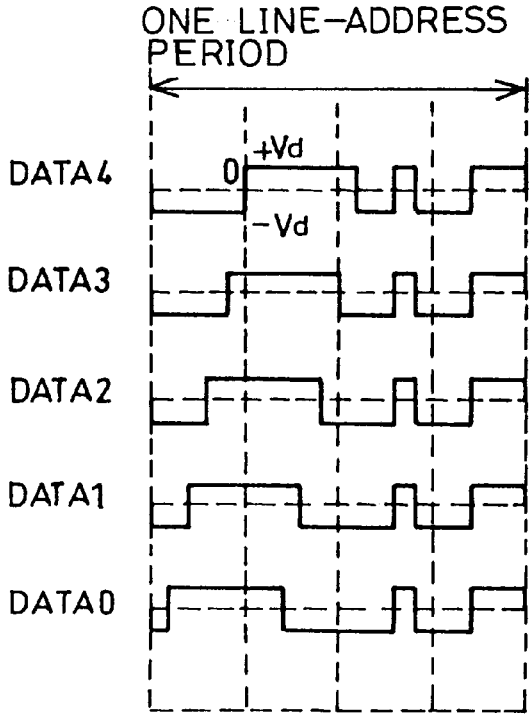
Figure 6:
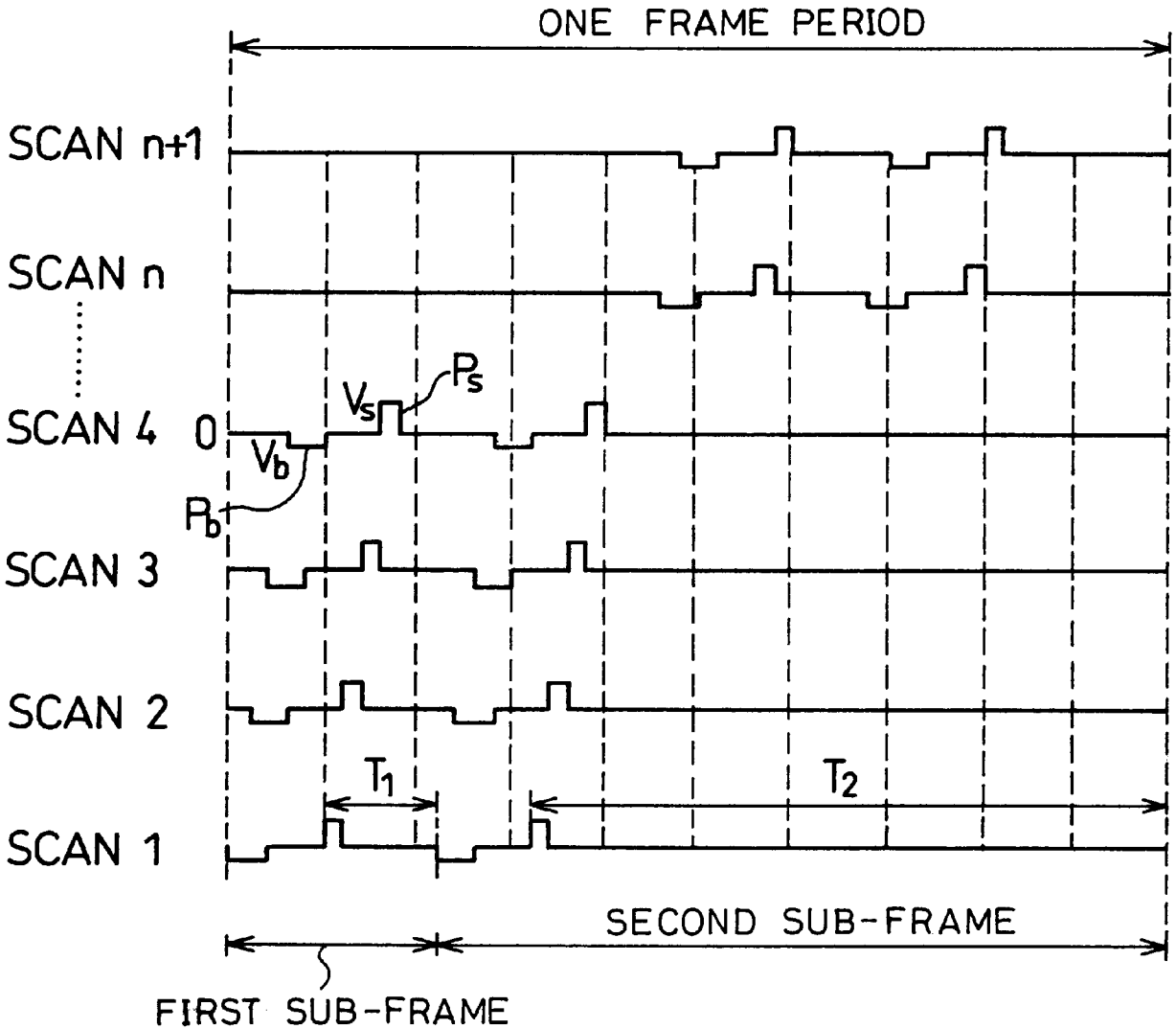
FIG. 6 is a wave-form diagram showing a scanning signal applied to scanning line electrodes included in the foregoing FLC cell and in conventional FLC cells.

As shown in FIG. 4, the gray-scale signal producing circuit 43 is made up of a counter 44 and a gate circuit 45. The counter 44 outputs a four-bit signal, based on a clock CLK of regular cycle T. The gate circuit 45 is a circuit which combines, as needed, logic gates such as AND, OR, etc., and outputs, based on the signal from the counter 44, gray-scale signals DATA0 through DATA4 (see FIGS. 5(*a*) through 5(*d*)) of desired wave-form.

The gray-scale signal amplifying circuit 42 includes a data selector 46, a photo-coupler 47, and an operational amplifier 48. The data selector 46 selects one of the gray-scale signals DATA0 through DATA4, based on a bit pattern signal in accordance with display information (gray-scale information) provided by a high-level computing system. The operational amplifier 48 amplifies the gray-scale signal from the data selector 46, and outputs it to a single signal line electrode 21. The photo-coupler 47 electrically insulates the transmission of the signal from the data selector 46 to the operational amplifier 48. Data selectors 46, photo-couplers 47, and operational amplifiers 48 are provided in the same number as the signal line electrodes 21 . . . .

As shown in FIG. 1, the scanning line electrodes 31 . . . are connected to a scanning signal amplifying circuit 52 via a flexible print substrate 51. The scanning signal amplifying circuit 52 successively outputs to each scanning line electrode 31 a scanning signal, such as that shown in FIG. 6, based on blanking pulses $P_b$ (erasure pulses) with voltage $V_b$ (erasure voltage) and strobe pulses $P_s$ (selection pulses) with voltage $V_s$ (selection voltage) produced by a scanning signal producing circuit 53. The scanning signal amplifying circuit 52 and the scanning signal producing circuit 53 form parts of the scanning line electrode driving circuit of the present FLC module.

A voltage other than voltages $V_b$ and $V_s$, one which is at ground level, corresponds to a non-selection voltage.

The gray-scale signals shown in FIG. 5(*a*) have a group of voltage pulses which are phase modulated over the period as a whole (one line-address period) by the gate circuit 45. These pulses are rectangular pulses with voltage $\pm V_d$, and, over the period as a whole, have equilibrium from the point of view of direct current (are DC balanced). Further, in these gray-scale signals, within each line-address period, at least one of either the $+V_d$ level or the $-V_d$ level is maintained for ½ of the line-address period. The data selector 46 chooses a suitable group of pulses in accordance with the gray-scale information, and outputs one of the gray-scale signals phase-modulated in accordance with the gray-scale information.

In the present embodiment, the gray-scale signal DATA4 functions as writing signal, and the gray-scale signal DATA0 functions as holding signal. The other gray-scale signals DATA1 through DATA3, depending on their wave-forms, function either as writing signals or holding signals. However, here it is more appropriate to call the gray-scale signals DATA1 through DATA3 intermediate signals, for display of intermediate shades.

Again, the gray-scale signal producing circuit 43 may also be a circuit in which a certain wave-form is stored in advance, and then successively outputted with a desired phase in accordance with the gradation to be displayed. Specifically, a ROM which stores the wave-form is provided as the gray-scale signal producing circuit 43, and the above-mentioned computing system controls the phase with which the ROM outputs the wave-form. This gray-scale signal producing circuit 43 has a simple structure, and thus the cost of the driving system can be reduced.

In the foregoing example, five levels of gradation are expressed by the gray-scale signals DATA0 through DATA4, but, by changing the extent of phase modulation (phase shift) of the pulse group, gray-scale signals for more levels of gradation can be produced. By using gray-scale signals with this kind of wave-form, during a selection period, a composite pulse of the strobe pulse $P_s$ and the group of pulses of the gray-scale signal provides a difference in FLC driving characteristics, and thus a stable intermediate shade state can be displayed.

FLC driving characteristics in response to the composite pulse (of the strobe pulse $P_s$ and the group of pulses of the gray-scale signal) during a selection period are easily influenced by the wave-form of the signals before and after the selection period (the above-mentioned wave-form effect). In this case, a marked influence is exerted by the voltage of the gray-scale signal immediately preceding the selection period, which is directly related to switching of the alignment state. With the gray-scale signal wave-form shown in FIG. 5(*a*), when the gray-scale signal immediately preceding the selection period has a different wave-form, even if the same gray-scale signal is chosen in the selection period, the two signals result in different driving characteristics, and display of a stable intermediate shade will likely be impossible.

In contrast, with the gray-scale signals shown in FIG. 5(*b*), there is a phase-modulated pulse in the first half, and a fixed-phase pulse in the second half, of each line-address period. If these gray-scale signals are used, since the pulses in the second half of the line-address period, of whatever gray-scale signal, have a fixed phase, stable driving characteristics can be obtained by the subsequent gray-scale signal, with no influence from the wave-form of the preceding gray-scale signal. The gray-scale signals shown in FIGS. 5(*c*) and 5(*d*) also have fixed-phase pulses in the second half of the line-address period, and can obtain stable driving characteristics in the same way.

It is sufficient if the gray-scale signals in FIGS. 5(*b*) through 5(*d*) are DC balanced over the whole of the line-address period, and need not be DC balanced within the modulated portion (in which the pulse group is phase-modulated) and within the fixed portion (in which the pulse group is fixed-phase).

Again, in the gray-scale signal shown in FIG. 5(*c*), the lengths of the modulated portion and the fixed portion are not equal, with the modulated portion making up more than half of the line-address period. By this means, when the strobe pulse $P_s$ applied to a scanning line electrode 31 during the selection period is combined together with the pulses of the gray-scale signal applied to a signal line electrode 21, a group of pulses having more differences in characteristics can be applied to the pixel. Consequently, the number of possible application voltages when choosing a suitable gradation display can be increased.

Further, in the gray-scale signals shown in FIGS. 5(*b*) and 5(*c*), the number of changes in voltage differs for DATA0 and DATA4. For this reason, when the pulses of the gray-scale signal and the strobe pulse $P_s$ are combined together at the time of application of voltage to a pixel, the number of changes in the voltage applied to the pixel when DATA4 is successively applied will be double the number of changes in voltage when DATA0 is successively applied. Since changes in the voltage applied cause heating of the pixel, if the display contents (gray-scale signal) gives rise to a difference in the number of changes in the voltage applied, there will be temperature differences between different pixels.

In contrast, in each of the gray-scale signals DATA0 through DATA4 shown in FIG. 5(*d*), a fixed-phase pulse at the end of the line-address period is preceded by a pulse of smaller width, which has the same phase in each of DATA0 through DATA4. By this means, the number of changes in voltage during a line-address period is equivalent for each of the gray-scale signals DATA0 through DATA4. Accordingly, the number of changes in the voltage applied to a pixel will always be uniform, for whatever combination of gray-scale signals. As a result, the temperatures of different pixels can be expected to be uniform, regardless of the display contents.

CONCRETE EXAMPLE 1

The following will explain driving characteristics capable of obtaining light transmittance of 100% or 0% using the five kinds of gray-scale signals DATA0 through DATA4.

The liquid crystal cell used in making the measurements below was the so-called "standard cell" for prototype testing, filled with an FLC material in which the anisotropy of the dielectric constant is negative. As to the range of voltage applied to this standard cell, in order to avoid change of the alignment state, for the gray-scale signal shown in 5(*b*), a voltage $V_d$ (data pulse root-mean-square voltage, i.e., gray-scale signal voltage) was set to a root-mean-square voltage of 8V, and for the strobe pulse $P_s$, a voltage $V_s$ (strobe pulse voltage) was set to a maximum voltage of 45V.

The maximum amplitude voltage of the gray-scale signal in FIG. 5(*b*) was ±8V.

In making the measurements below, during the selection period, DATA4 was applied for light state, and DATA0 was applied for dark state. Immediately preceding and following the selection period, each of DATA0, DATA2, and DATA4 was applied, and during other non-selection periods, DATA4 was continuously applied.

Figure 7:
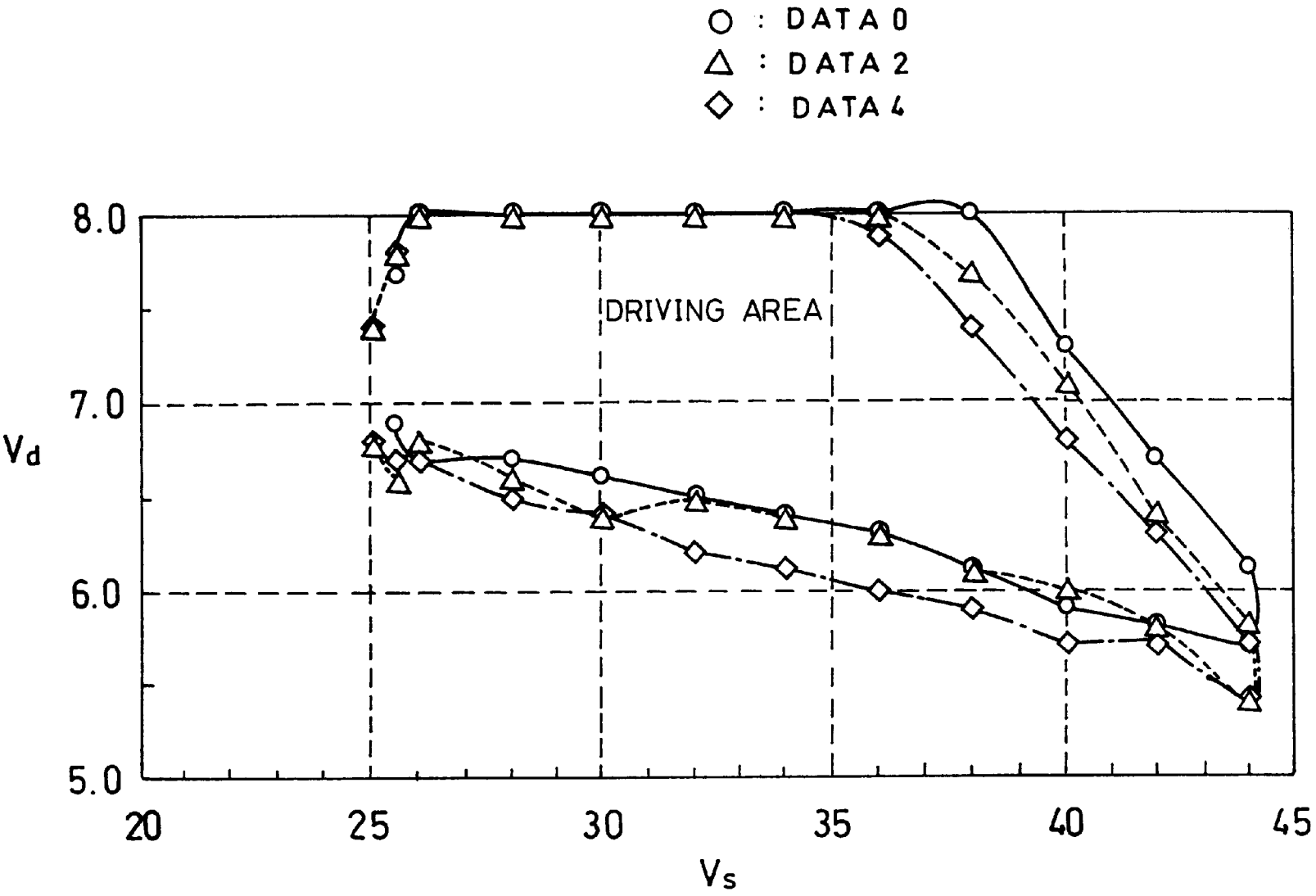
FIG. 7 is a graph showing, in Concrete Example 1, the range of driving voltage within which two-value driving is possible when the gray-scale signals preceding and following the selection period are changed.

Measurement of driving characteristics under the foregoing conditions yielded a voltage range within which gray-scale driving is possible, as shown in FIG. 7. In FIG. 7, the plot marks ○, Δ, and ◇ show the measured results for DATA0, DATA2, and DATA4. The areas within each of the loops formed by plot marks of the same type show the range of combinations of strobe pulse voltages $V_s$ and data pulse root-mean-square voltages $V_d$ within which complete switching between the two values of light and dark state is possible. The areas outside the loops show the range of combinations of voltage where it is not possible to completely switch to either light or dark state, or both.

The more the shapes of the various loops are the same regardless of differences in preceding and following gray-scale signals, the less is the influence of wave-form effect. Accordingly, as shown in FIG. 7, when the gray-scale signal in FIG. 5(*b*) is used, the shapes of the loops are very similar, and thus it is clear that stable driving characteristics can be obtained. Again, the range of driving voltages necessary for complete switching between at least the two states light and dark is the voltage range inside the innermost loop. Consequently, as shown in FIG. 7, since all of the loops are large, it can be seen that there is a large range of voltages capable of driving with the foregoing gray-scale signal.

COMPARATIVE EXAMPLE 1

Figure 19:
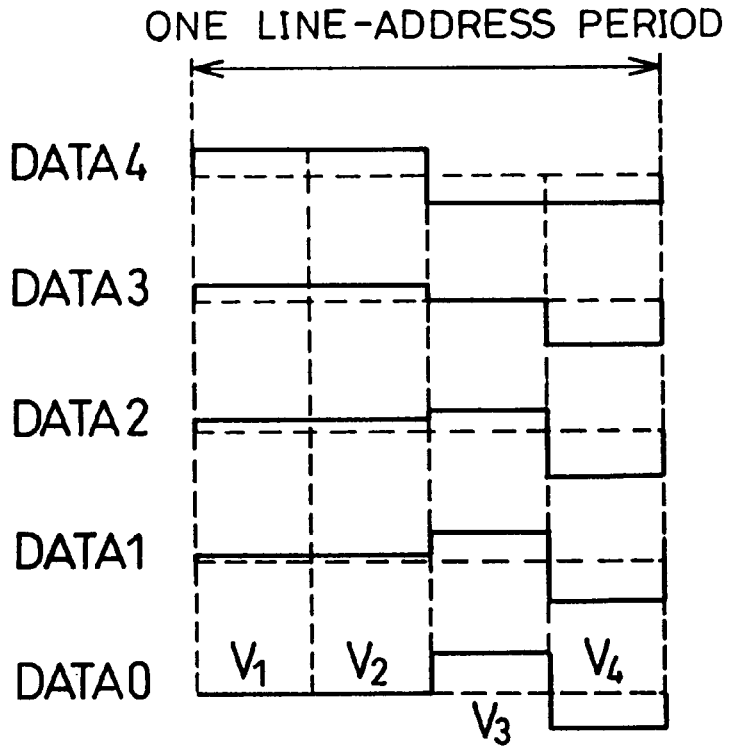
FIG.19 PRIOR ART
FIG. 19 is a wave-form diagram showing an amplitude-modulated gray-scale signal conventionally used in a passive-matrix liquid crystal display element.
Figure 20:
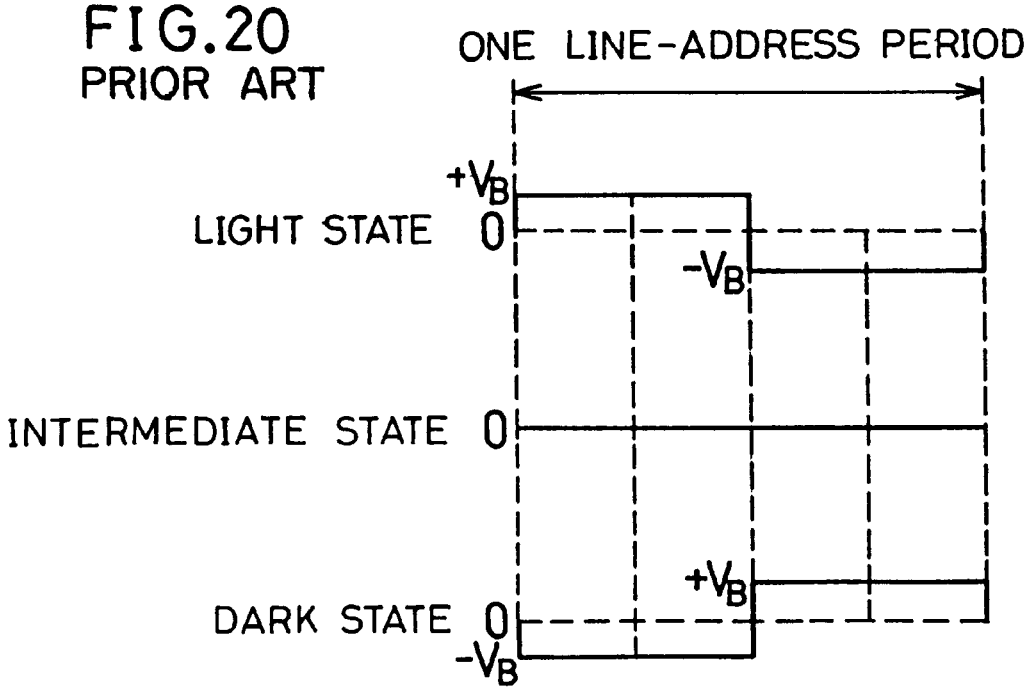
FIG.20 PRIOR ART
FIG. 20 is a wave-form diagram showing another amplitude-modulated gray-scale signal conventionally used in a passive-matrix liquid crystal display element.

Using the conventional amplitude-modulated gray-scale signal shown in FIG. 19, measurements were made under the same conditions as in Concrete Example 1 above.

When using the gray-scale signal in FIG. 19, the root-mean-square values of each of DATA0 through DATA4 are equal, and if $V_{rms}$ is the root-mean-square value of the gray-scale signal voltage $V_d$, $N_D$ is the data number, and $N_G$ is the number of gradations, the voltage of each data signal is as defined by:

$$V_1=V_2=V_{rms}\times N_D/N_G$$

$$V_3=-V_1+[2(V_{rms}^2-V_1^2)]^{1/2}$$

$$V_4=-(2V_1+V_3)$$

The maximum amplitude voltage of the gray-scale signal in FIG. 19 was ±11.2V.

Figure 8:
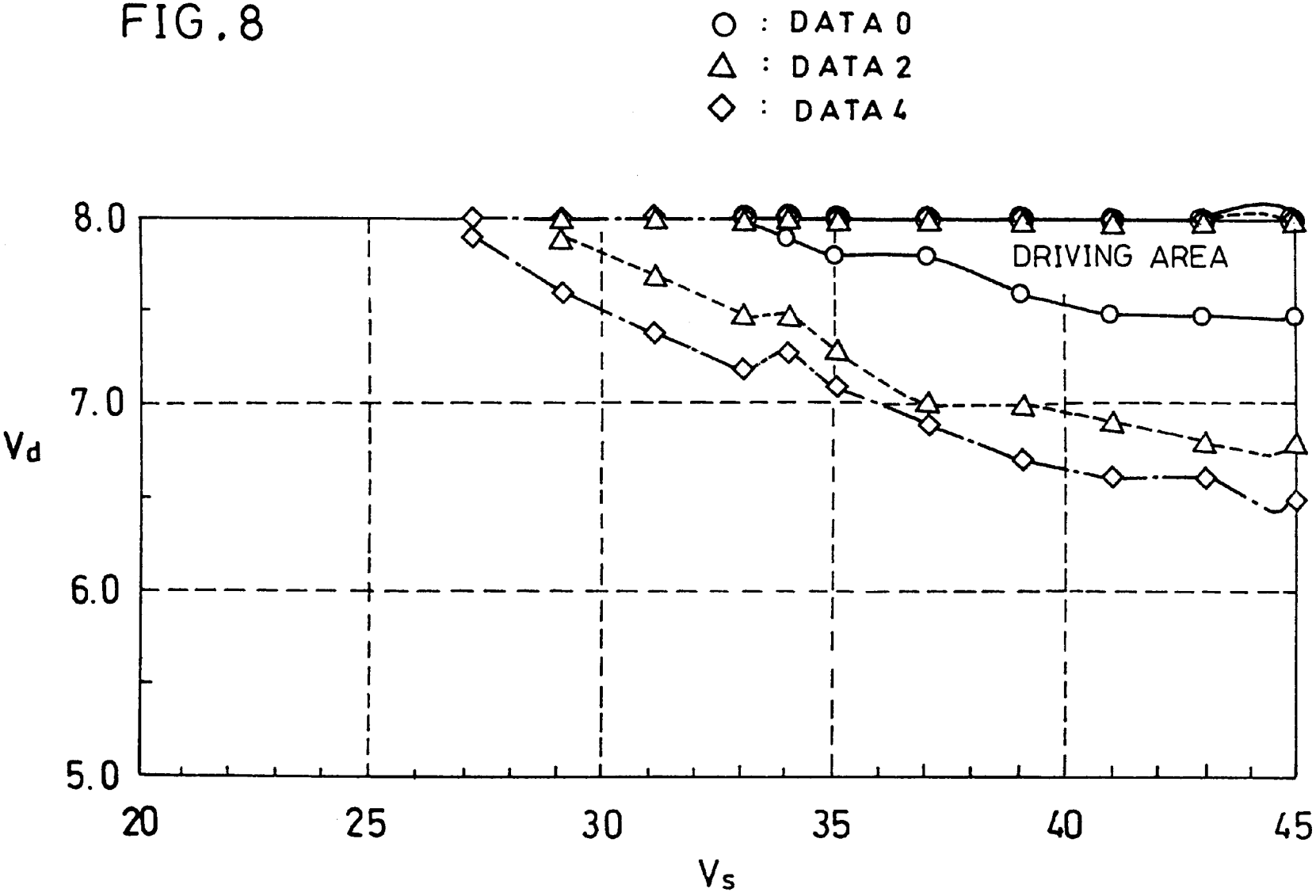
FIG. 8 is a graph showing, in Comparative Example 1, the range of driving voltage within which two-value driving is possible when gray-scale signals preceding and following the selection period are changed.

Measurement of driving characteristics under the foregoing conditions yielded the driving characteristics shown in FIG. 8. In comparing the driving characteristics of the present Comparative Example (conventional two-value driving) with those of Concrete Example 1, in both cases, suitable driving requires combinations of the strobe pulse voltage $V_s$ and the data pulse root-mean-square voltage $V_d$ falling within a range inside the innermost loop.

In the present Comparative Example, as shown in FIG. 8, the driving voltage range determined by the innermost loop DATA0 is much smaller than the driving voltage range of Concrete Example 1 (FIG. 7). From this, it can be seen that, when a conventional amplitude-modulated gray-scale signal is used, the voltage range within which stable driving can be performed is much more limited than in the case of Concrete Example 1.

CONCRETE EXAMPLE 2

Next, apparent memory angle was measured when a single gray-scale signal was applied continuously to the standard cell. Here, the gray-scale signal shown in FIG. 5(*b*) was used, and $V_d$ was set so that the root-mean-square value was 5V. The length of the selection period was 34.72 μs.

Figure 9:
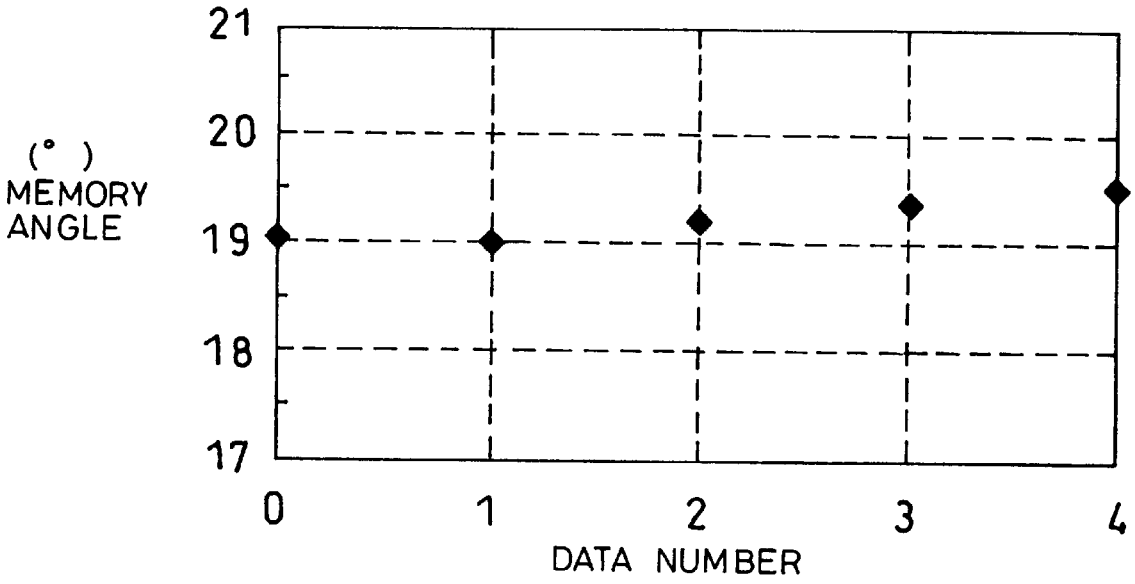
FIG. 9 is a graph showing, in Concrete Example 2, memory angle when each gray-scale signal is continuously applied.
Figure 10:
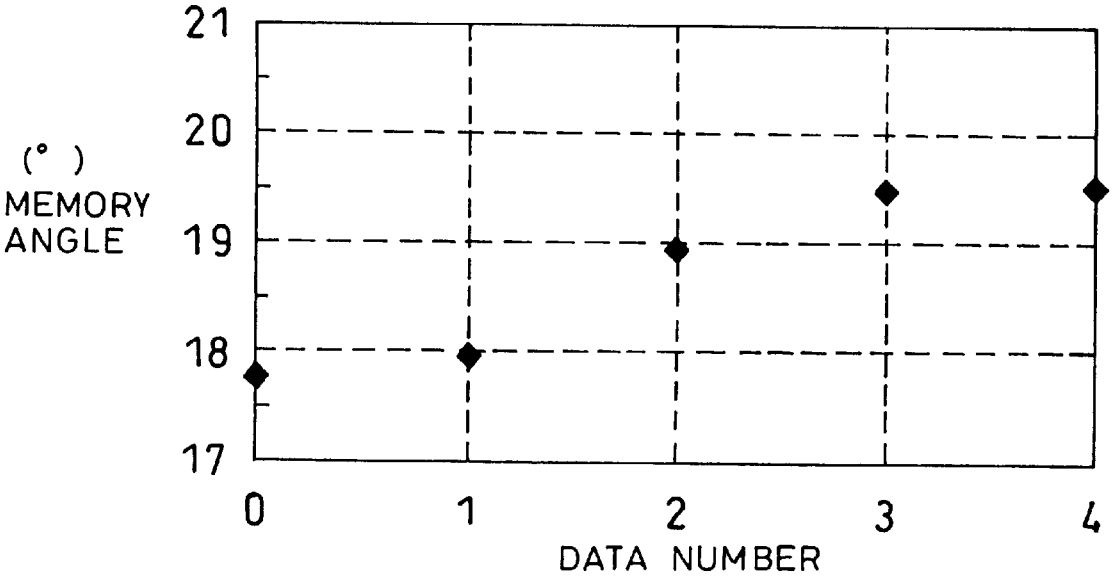
FIG. 10 is a graph showing, in Comparative Example 2, memory angle when each gray-scale signal is continuously applied.

As a result of these measurements, as shown in FIG. 9, when DATA0 through DATA4 were continuously applied to a pixel, a difference in memory angle of approximately 0.5° was found between DATA0 and DATA4. In this case, continuous application of DATA0 and DATA4 to the FLC results in a difference in bias frequency (frequency of a signal made up of a continuous wave-form) of two times. Based on this difference in bias frequency, the memory angle changes in accordance with the liquid crystal's electro-optical properties, thus giving rise to the foregoing difference in memory angle.

In this way, in the present Concrete Example, the apparent memory angle of the FLC is substantially the same, regardless of the gray-scale signal applied. Consequently, in the FLC cell 1, a stable gradation can always be maintained, without being influenced by display pattern.

COMPARATIVE EXAMPLE 2

Using the conventional amplitude-modulated gray-scale signal shown in FIG. 19 (root-mean-square value of voltage: 5V), measurements were made under the same conditions as in Concrete Example 2 above. As a result, the memory angles shown in FIG. 10 were obtained. In the present Comparative Example, a difference in memory angle of approximately 1.7° was found between DATA0 and DATA4.

This difference arises because the FLC responds to the various voltages included in the gray-scale signal. Accordingly, when a conventional amplitude-modulated gray-scale signal is used, stable gradation display like that of Concrete Example 2 cannot be performed.

CONCRETE EXAMPLE 3

Next, optical response was measured when performing gray-scale driving of a standard FLC cell with negative anisotropy of the dielectric constant. Here, using the gray-scale signal wave-form shown in FIG. 5(*b*), driving was performed under the following conditions. Namely, with a frame frequency of 60 Hz, each frame was divided into two sub-frames with a ratio of 1:5. The strobe pulse voltage $V_s$ was set to 37V, the gray-scale signal voltage $V_d$ was set so that the root-mean-square value was 5V, the length of the selection period was set to 21.72 $\mu$s, and the measurement temperature was set to 30.0° C.

Figure 11:
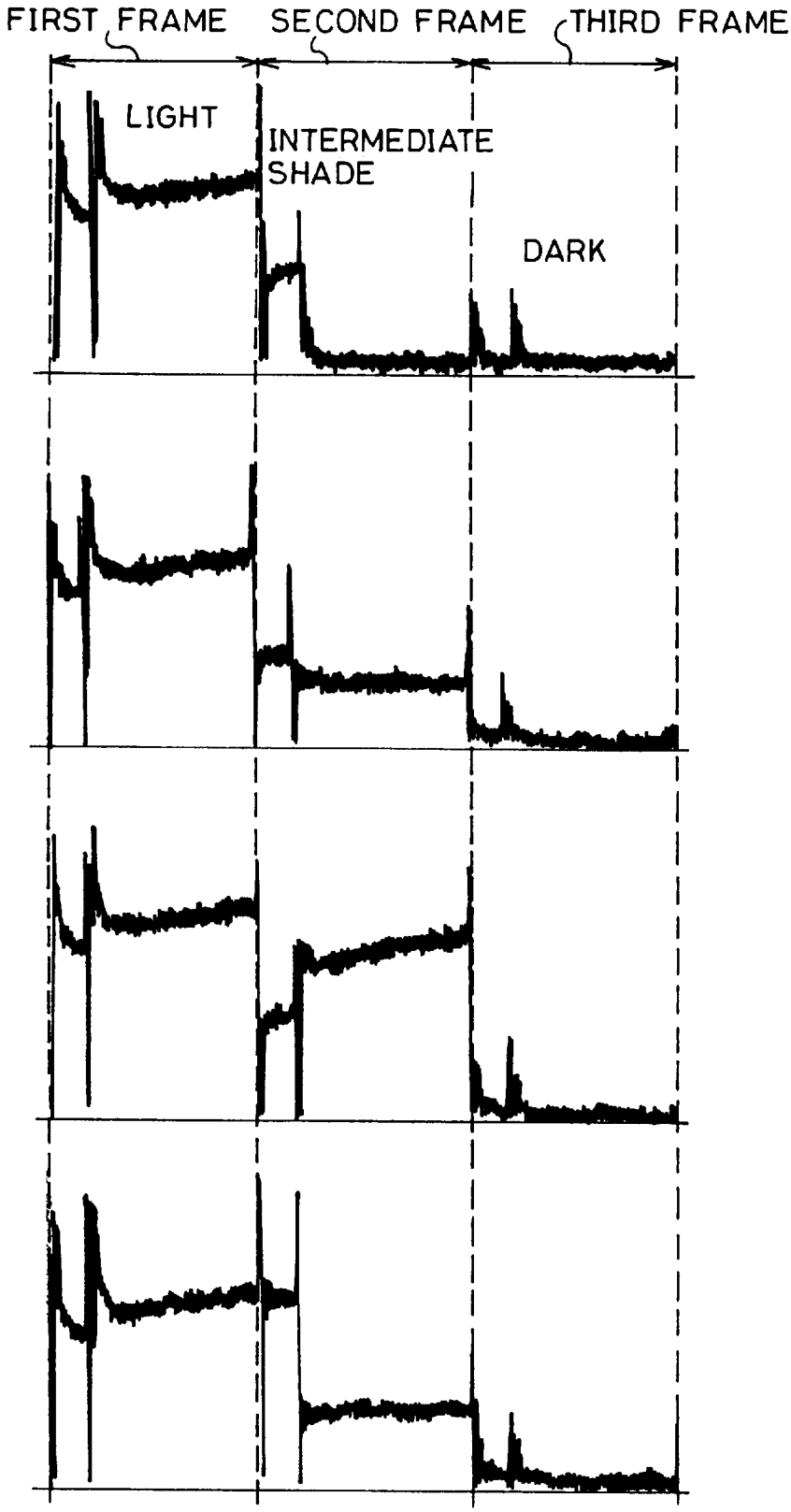
FIG. 11 is a wave-form diagram showing optical responses in Concrete Example 3.
Figure 12:
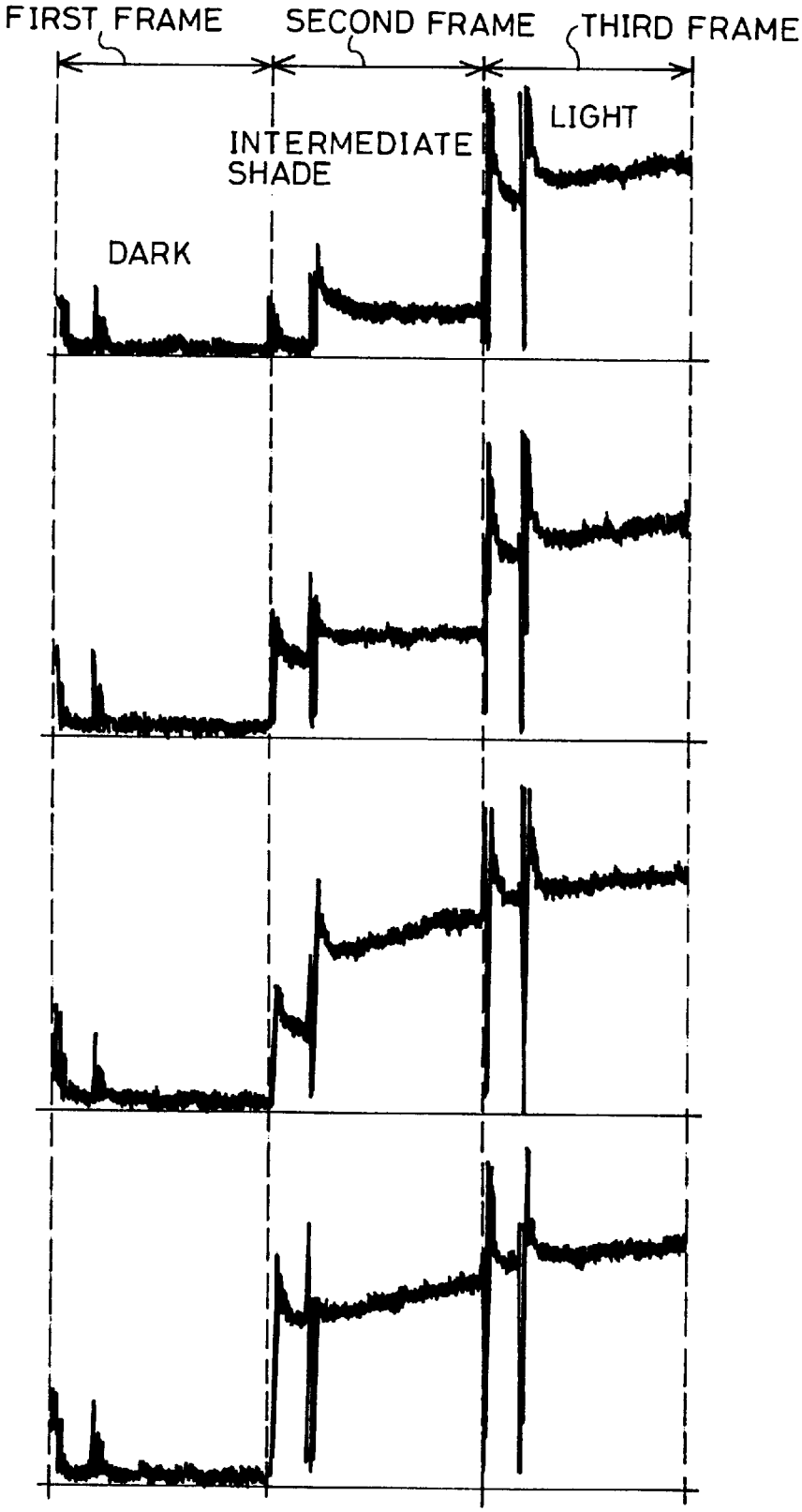
FIG. 12 is a wave-form diagram showing other optical responses in Concrete Example 3.

FIGS. 11 and 12 show four types each of optical responses obtained as a result of the foregoing measurements, each extending over three frames. In the optical responses in FIG. 11, the second frame (in the center) shows the state of display of an intermediate shade (intermediate state), and the first and third frames (on the left and right, respectively) show light and dark states, respectively. In the optical responses in FIG. 12, on the other hand, the second frame shows an intermediate state, and the first and third frames show dark and light states, respectively.

In view of the number of possible display combinations, there are a huge number of possible optical responses. FIGS. 11 and 12 only give a few examples in which intermediate states (intermediate shades) were obtained. Actually, there is a gray-scale level for each display bit in the divided frame.

In the optical responses of FIG. 12, the four second frames show progressively higher gray scale levels. Again, in the optical responses of FIG. 11, the upper three patterns show cases in which the display bit of the short sub-frame is in an intermediate state, and the gray-scale level is increased in the display bit of the long sub-frame. In the lowest pattern in FIG. 11, the display bit of the short sub-frame displays a light state, and the display bit of the long sub-frame displays an intermediate state.

From the foregoing results, it can be seen that intermediate shades can be stably displayed using the gray-scale signals of the present invention.

COMPARATIVE EXAMPLE 3

Figure 13:
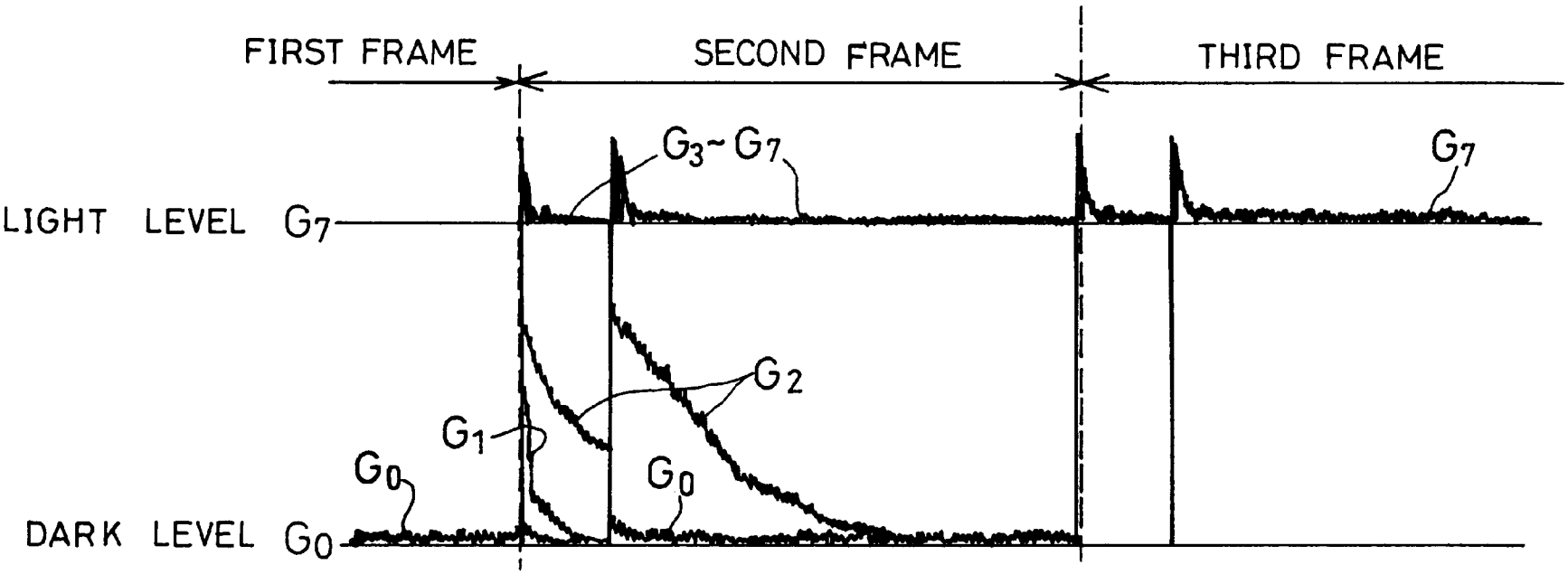
FIG. 13 is a wave-form diagram showing optical responses in Comparative Example 3.
Figure 14:
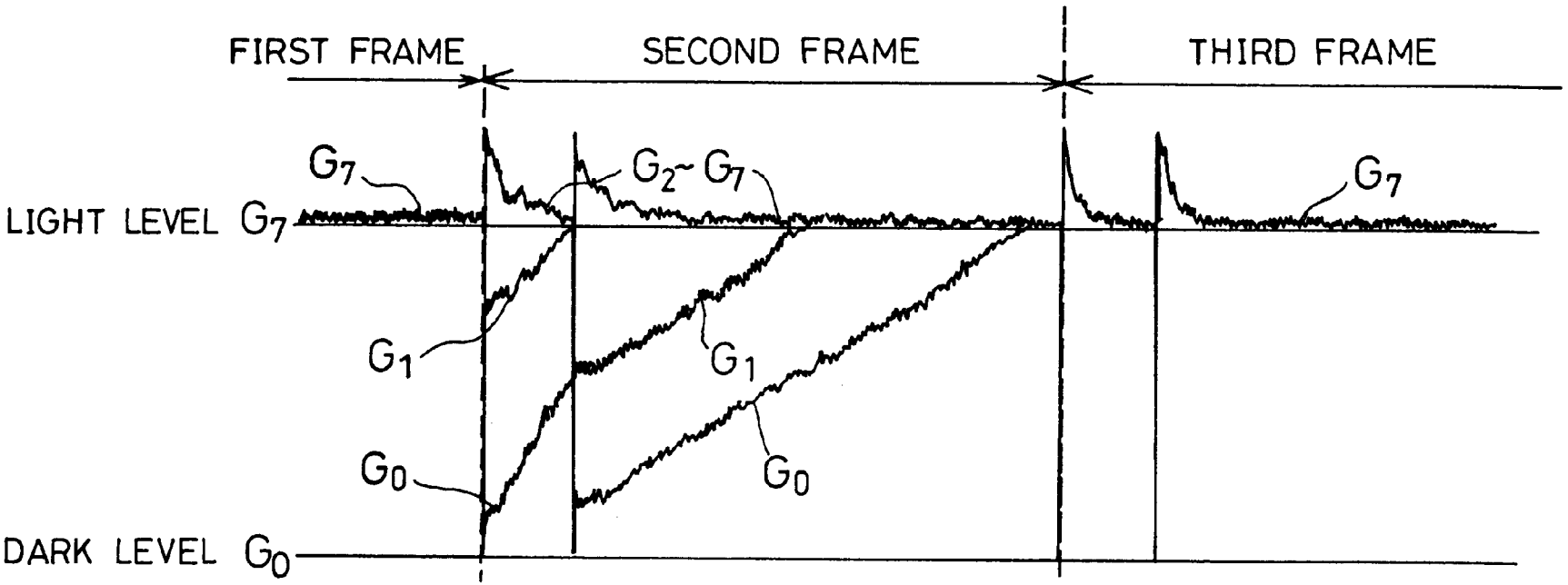
FIG. 14 is a wave-form diagram showing other optical responses in Comparative Example 3.
Figure 15:
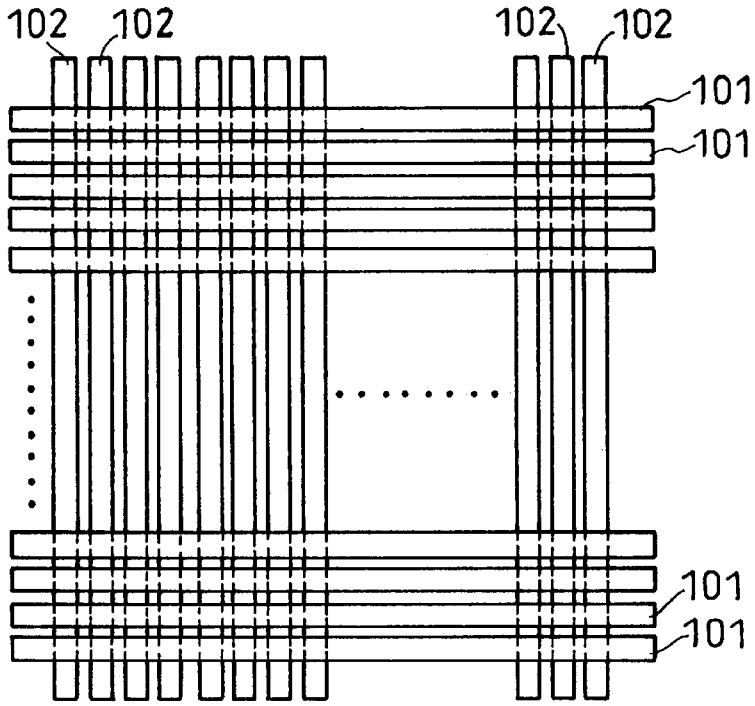
FIG. 15 is a plan view showing a typical arrangement of electrodes in a passive-matrix liquid crystal display element.
Figure 16:
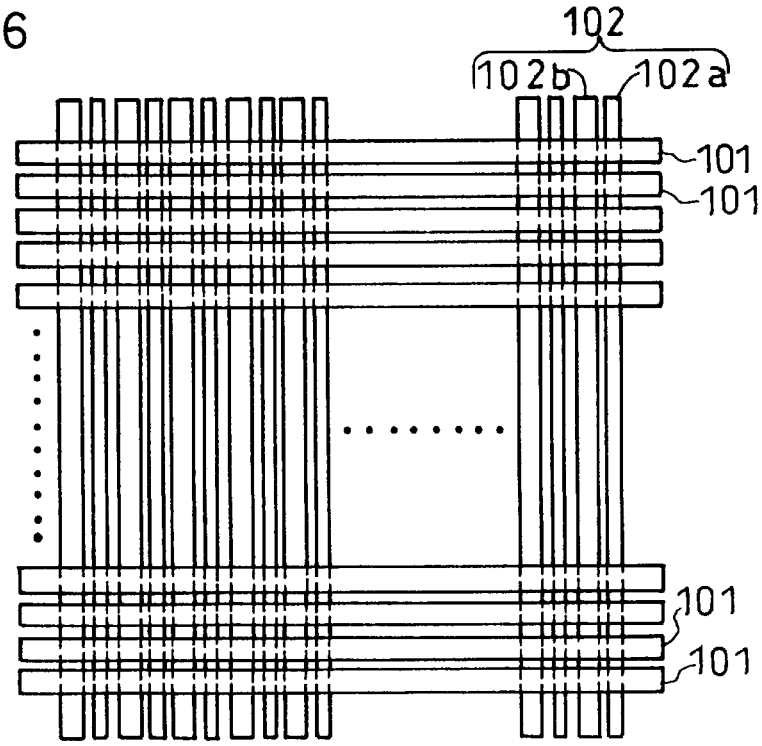
FIG. 16 is a plan view showing the arrangement of electrodes in a pixel-divided passive-matrix liquid crystal display element.
Figure 17:
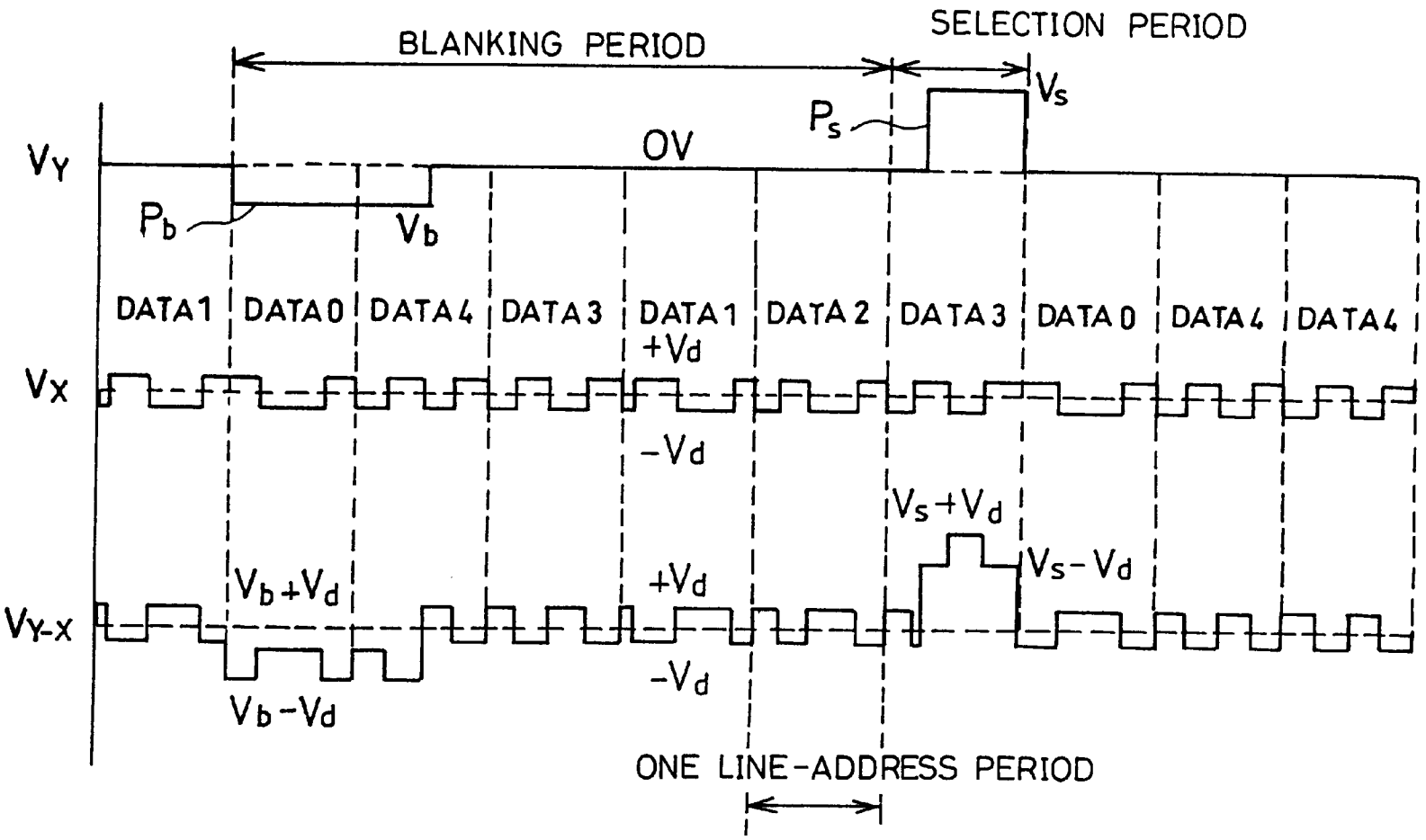
FIG.17 PRIOR ART
FIG. 17 is a wave-form diagram showing a driving signal conventionally used in a passive-matrix liquid crystal display element.
Figure 18:
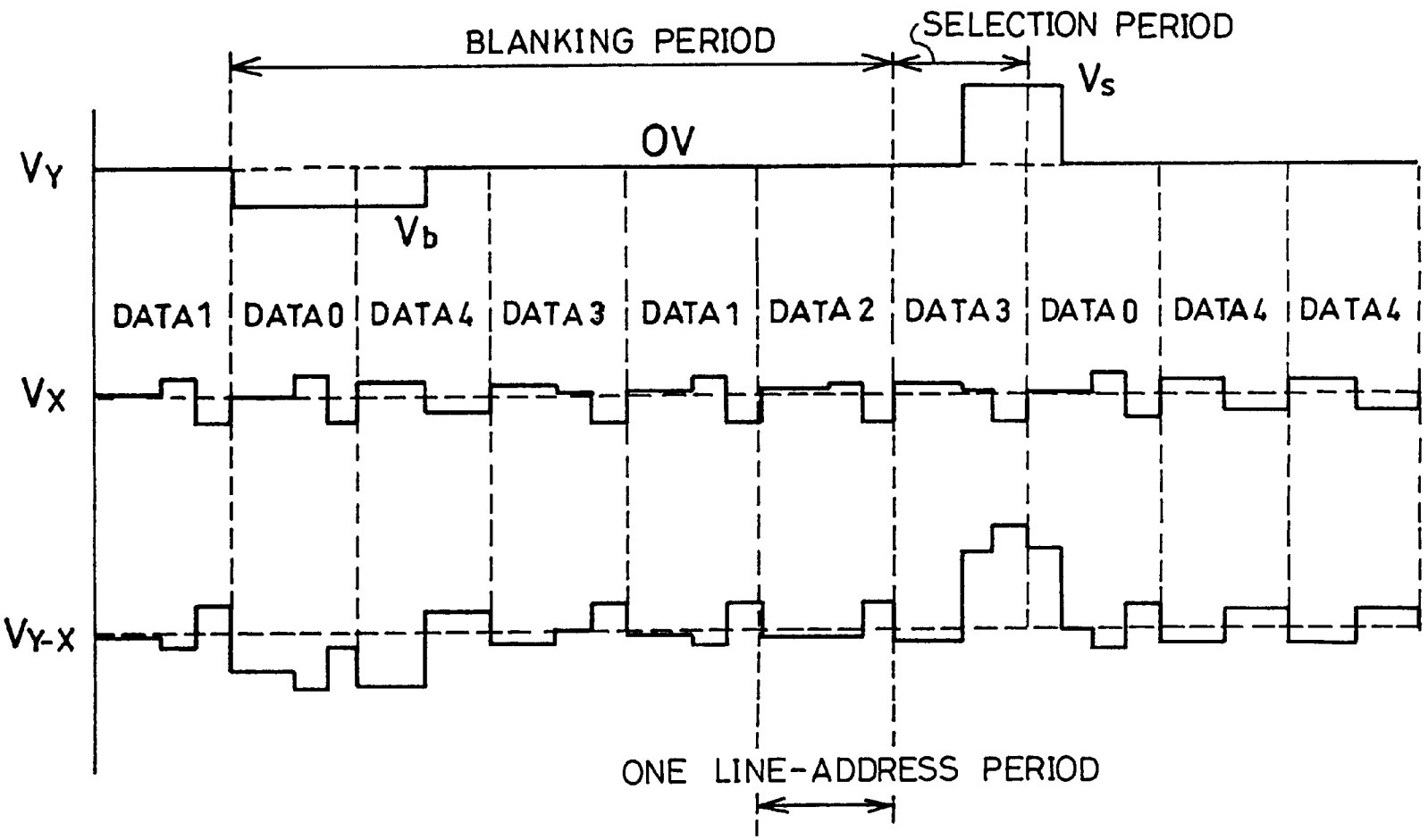
FIG.18 PRIOR ART
FIG. 18 is a wave-form diagram showing another driving signal conventionally used in a passive-matrix liquid crystal display element.

Measuring optical response under conditions substantially equivalent to those of Concrete Example 3, using an eight-gradation gray-scale signal (not shown) different from that shown in FIG. 19, resulted in the optical responses shown in FIGS. 13 and 14.

In the optical responses shown in FIGS. 13 and 14, it can be seen that, in the intermediate-state second frame, the wave-forms of gray-scale levels $G_0$ through $G_7$, which have characteristic differences in wave-form, are altered by the influence of the wave-form of the first frame. Again, in the optical response shown in FIG. 13, gray-scale levels $G_3$ through $G_7$ are substantially equal, and in the optical response shown in FIG. 14, gray-scale levels $G_2$ through $G_7$ are substantially equal.

In this way, when an amplitude-modulated gray-scale signal is used, even if frame-division periods are adjusted and gray-scale level is optimized, the only gray-scale level which can be produced over the whole of the frame is a non-linear, scattered one. Again, depending on the state of the preceding frame, there are cases in which the same intermediate shade cannot be recreated.

As discussed above, the driving method according to the present invention is a method of driving an FLC cell 1 made up of a plurality of scanning line electrodes 31 . . . running perpendicular to a plurality of signal line electrodes 21 . . . , with FLC provided between the scanning line electrodes 31 . . . and the signal line electrodes 21 . . . , and a pixel provided near each intersection of a scanning line electrode 31 with a signal line electrode 21; which changes the state of display of each pixel by:

(i) selectively applying to a signal line electrode 21 a writing signal which causes the FLC within the pixel to shift to one of two stable states, and a holding signal which maintains the stable state of the FLC; and simultaneously:

(ii) selectively applying to a scanning line electrode 31 an erasure voltage which causes the FLC within the pixel to shift to one of two stable states, a selection voltage which applies to the pixel a gray-scale signal, which is a wave-form in accordance with a gray-scale level, and which includes the writing signal and the holding signal, and a non-selection voltage which maintains the stable state of the FLC; the erasure, selection, and holding voltages being applied, respectively, during an erasure period, a selection period, and a non-selection period of variable length between the selection period and the erasure period, each of which is provided during each scanning period; and applying to each of the scanning line electrodes 31 . . . to which the erasure voltage, selection voltage, and non-selection voltage are not applied a voltage having the same wave-form as at least one of the voltages applied thereto in the preceding scanning period, with a phase such that inconsistencies will not arise in the display state, and balancing, from the point of view of direct current, each of the voltages during one scanning period;

in which method, the gray-scale signals applied to the signal line electrodes 21 . . . include phase-modulated pulses.

By using the foregoing gray-scale signals, based on differences in phase during the selection period, the FLC can be given differences in switching characteristics in response to the voltage applied thereto. Consequently, intermediate shades can be displayed without using amplitude-modulated or frequency-modulated gray-scale signals. Accordingly, intermediate shades can be displayed stably.

With the foregoing driving method, it is preferable if gray-scale signals are used in which some of the pulses are fixed-phase, so that they are not dependent on the gray-scale level. If these gray-scale signals are used, since the phase of the pulses is fixed, whatever the gray-scale signal, the switching characteristics of the gray-scale signal wave-form applied during the selection period are fixed, regardless of the type of gray-scale signal wave-form applied in the preceding period. As a result, driving characteristics are even more stable, and intermediate shades can be displayed even more stably.

It is even more preferable if the gray-scale signals used have, in each scanning period, two portions, a first portion containing phase-modulated pulses, and a second portion containing fixed-phase pulses, and if the duration of the first portion is longer than one-half of the scanning period. By phase modulating the first portion of the gray-scale signal, the switching characteristics of the gray-scale signal can be given more differences. Accordingly, switching of more intermediate shades can be performed.

In the foregoing driving method, by using gray-scale signals whose pulses are set to two levels of opposite polarity of the same absolute value, the number of voltages applied to the pixel can be reduced. Consequently, differences in the FLC's memory angle during non-selection periods, and heating of the pixel in proportion to the square of the voltage applied, can be held to a minimum. In addition, since the circuit for producing the gray-scale signals need produce only two voltages, the number of outputted voltages can be decreased in comparison with conventional methods. Accordingly, change of the cell's temperature due to display contents can be suppressed, driving characteristics can be stabilized, and the structure of the driving circuit can be streamlined.

In the foregoing driving method, by using gray-scale signals in which the number of changes in level of the pulses is always fixed within each scanning period, differences in frequency among gray-scale signals are eliminated, and thus, even if gray-scale signals of different phase are combined together in each scanning period, the voltage applied to the pixel changes with a fixed frequency. Consequently, heating of the pixel due to frequency differences can be suppressed. Accordingly, intermediate shades can be displayed stably.

The driving circuit according to the present invention is a circuit for changing the state of display in each pixel of an FLC cell 1 made up of a plurality of scanning line electrodes 31 . . . running perpendicular to a plurality of signal line electrodes 21 . . . , with FLC provided between the scanning line electrodes 31 . . . and the signal line electrodes 21 . . . , and a pixel provided near each intersection of a scanning line electrode 31 with a signal line electrode 21; which is made up of:

(i) a signal line electrode driving circuit for selectively applying to a signal line electrode 21 a writing signal which causes the FLC within the pixel to shift to one of two stable states, and a holding signal which maintains the stable state of the FLC; and (ii) a scanning line electrode driving circuit for selectively applying to a scanning line electrode 31 an erasure voltage which causes the FLC within the pixel to shift to one of two stable states, a selection voltage which applies to the pixel a gray-scale signal, which is a wave-form in accordance with a gray-scale level, and which includes the writing signal and the holding signal, and a non-selection voltage which maintains the stable state of the FLC; the erasure, selection, and holding voltages being applied, respectively, during an erasure period, a selection period, and a non-selection period of variable length between the selection period and the erasure period, each of which is provided during each scanning period; and for applying to each of the scanning line electrodes 31 . . . to which the erasure voltage, selection voltage, and non-selection voltage are not applied a voltage having the same wave-form as at least one of the voltages applied thereto in the preceding scanning period, with a phase such that inconsistencies will not arise in the display state; and which balances, from the point of view of direct current, each of the voltages during one scanning period;

in which the gray-scale signals applied to the signal line electrodes 21 . . . by the signal line electrode driving circuit include phase-modulated pulses.

With the foregoing structure, in driving the FLC cell 1, the signal line electrode driving circuit applies to the signal line electrodes pulses which are phase-modulated in accordance with the gray-scale level outputted, and the scanning line electrode driving circuit applies to the scanning line electrodes pulses including the erasure voltage, selection voltage, and non-selection voltage. Then, a voltage resulting from combining both of the foregoing pulses is applied to the pixel.

By using the foregoing gray-scale signals in this kind of driving, based on differences in phase during the selection period, the FLC can be given differences in switching characteristics in response to the voltage applied thereto. Consequently, intermediate shades can be displayed without using amplitude-modulated or frequency-modulated gray-scale signals. Accordingly, intermediate shades can be displayed stably.

With the foregoing driving circuit, it is preferable if the signal line electrode driving circuit produces gray-scale signals in which some of the pulses are fixed-phase, so that they are not dependent on the gray-scale level. If these gray-scale signals are used, since the phase of the pulses is fixed regardless of the kind of gray-scale signal, the switching characteristics of the gray-scale signal wave-form applied during the selection period are fixed, regardless of the type of gray-scale signal wave-form applied in the preceding period. As a result, driving characteristics are even more stable, and intermediate shades can be displayed even more stably.

It is even more preferable if the signal line electrode driving circuit produces gray-scale signals which have, in each scanning period, two portions, a first portion containing phase-modulated pulses, and a second portion containing fixed-phase pulses, and if the duration of the first portion is longer than one-half of the scanning period. By phase modulating the first portion of the gray-scale signal, the switching characteristics of the gray-scale signal can be given more differences. Accordingly, switching of more intermediate shades can be performed.

In the foregoing driving circuit, it is preferable if the signal line electrode driving circuit produces gray-scale signals whose pulses are set to two levels of opposite polarity of the same absolute value. In this way, by using gray-scale signals of two levels, the number of voltages applied to the pixel can be reduced. Consequently, differences in the FLC's memory angle during non-selection periods, and heating of the pixel in proportion to the square of the voltage applied, can be held to a minimum. In addition, since the circuit for producing the gray-scale signals need produce only two voltages, the number of outputted voltages can be decreased in comparison with conventional methods. Accordingly, change of the cell's temperature due to the display contents can be suppressed, driving characteristics can be stabilized, and the structure of the driving circuit can be streamlined.

In the foregoing driving circuit, it is preferable if the signal line electrode driving circuit produces gray-scale signals in which the number of changes in level of the pulses is always fixed within each scanning period. In this way, by using gray-scale signals with a set number of pulse level changes, differences in frequency among gray-scale signals are eliminated, and thus, even if gray-scale signals of different phase are combined together in each scanning period, the voltage applied to the pixel changes with a fixed frequency. Consequently, heating of the pixel due to frequency differences can be suppressed. Accordingly, intermediate shades can be displayed stably.

The embodiments and concrete examples of implementation discussed in the foregoing detailed explanations of the present invention serve solely to illustrate the technical details of the present invention, which should not be narrowly interpreted within the limits of such concrete examples, but rather may be applied in many variations without departing from the spirit of the present invention and the scope of the patent claims set forth below.

What is claimed is:

1. A driving method for changing the display state of each pixel of a liquid crystal display element made up of a plurality of scanning line electrodes provided so as to run perpendicular to a plurality of signal line electrodes, ferroelectric liquid crystal being provided between the scanning line electrodes and the signal line electrodes, and a pixel being provided near each intersection of a scanning line electrode with a signal line electrode;

the driving method comprising the steps of:

a first step for applying to a signal line electrode a plurality of gray-scale signals which include pulses which are phase-modulated in accordance with a gray-scale level, and which, from the point of view of direct current, are balanced within each line-address period; at least one of the gray-scale signals being a writing signal which causes the ferroelectric liquid crystal within the pixel to shift to one of two stable states; and at least one of the gray-scale signals being a holding signal which maintains the stable state of the ferroelectric liquid crystal; and a second step for selectively applying to a scanning line electrode a scanning signal which, from the point of view of direct current, is balanced within each scanning period, and which includes an erasure voltage which causes the ferroelectric liquid crystal within the pixel to shift to one of two stable states, a selection voltage which applies the gray-scale signals to the pixel, and a non-selection voltage which maintains the stable state of the ferroelectric liquid crystal; the erasure, selection, and holding voltages being applied, respectively, during an erasure period, a selection period, and a non-selection period of variable length between the selection period and the erasure period, each of which is provided during each scanning period.

2. The driving method set forth in claim 1, wherein:

in said first step, gray-scale signals are used in which some of the pulses have fixed phases, so as not to be dependent on gray-scale level.

3. The driving method set forth in claim 2, wherein:

in said first step, gray-scale signals are used which have, in each scanning period, two portions;

a first portion thereof containing phase-modulated pulses, and a second portion thereof containing fixed-phase pulses, and a duration of the first portion being longer than one-half of the scanning period.

4. The driving method set forth in claim 1, wherein:

in said first step, gray-scale signals are used whose pulses are set to two levels of opposite polarity and equivalent absolute value.

5. The driving method set forth in claim 1, wherein:

in said first step, gray-scale signals are used in which a number of value changes of the pulses per scanning period is always fixed.

6. A driving circuit for changing the display state of pixels of a liquid crystal display element made up of a plurality of scanning line electrodes provided so as to run perpendicular to a plurality of signal line electrodes, ferroelectric liquid crystal being provided between the scanning line electrodes and the signal line electrodes, and a pixel being provided near each intersection of a scanning line electrode with a signal line electrode;

the driving circuit comprising:

(i) a signal line electrode driving circuit for applying to a signal line electrode a plurality of gray-scale signals which include pulses which are phase-modulated in accordance with a gray-scale level, and which, from the point of view of direct current, are balanced within each line-address period; at least one of the gray-scale signals being a writing signal which causes the ferroelectric liquid crystal within the pixel to shift to one of two stable states; and at least one of the gray-scale signals being a holding signal which maintains the stable state of the ferroelectric liquid crystal; and (ii) a scanning line electrode driving circuit for selectively applying to a scanning line electrode a scanning signal which, from the point of view of direct current, is balanced within each scanning period, and which includes an erasure voltage which causes the ferroelectric liquid crystal within the pixel to shift to one of two stable states, a selection voltage which applies the gray-scale signals to the pixel, and a non-selection voltage which maintains the stable state of the ferroelectric liquid crystal; the erasure, selection, and holding voltages being applied, respectively, during an erasure period, a selection period, and a non-selection period of variable length between the selection period and the erasure period, each of which is provided during each scanning period.

7. The driving circuit set forth in claim 6, wherein:

said signal line electrode driving circuit produces gray-scale signals in which some of the pulses have fixed phases, so as not to be dependent on gray-scale level.

8. The driving circuit set forth in claim 7, wherein:

said signal line electrode driving circuit produces gray-scale signals which have, in each scanning period, two portions;

a first portion thereof containing phase-modulated pulses, and a second portion thereof containing fixed-phase pulses, and a duration of the first portion being longer than one-half of the scanning period.

9. The driving circuit set forth in claim 8, wherein said signal line electrode driving circuit comprises:

a counter, which outputs a signal made up of a plurality of bits based on a unit clock;

a gate circuit, which produces a plurality of gray-scale signals based on the signal outputted by said counter; and a data selector, which chooses a gray-scale signal based on display information.

10. The driving circuit set forth in claim 6, wherein:

said signal line electrode driving circuit produces gray-scale signals whose pulses are set to two levels of opposite polarity and equivalent absolute value.

11. The driving circuit set forth in claim 10, wherein said signal line electrode driving circuit comprises:

a counter, which outputs a signal made up of a plurality of bits based on a unit clock;

a gate circuit, which produces a plurality of gray-scale signals based on the signal outputted by said counter; and a data selector, which chooses a gray-scale signal based on display information.

12. The driving circuit set forth in claim 6, wherein:

said signal line electrode driving circuit produces gray-scale signals in which a number of value changes of the pulses per scanning period is always fixed.

13. The driving circuit set forth in claim 12, wherein said signal line electrode driving circuit comprises:

a counter, which outputs a signal made up of a plurality of bits based on a unit clock;

a gate circuit, which produces a plurality of gray-scale signals based on the signal outputted by said counter; and a data selector, which chooses a gray-scale signal based on display information.

* * * * *